US008333175B2

(12) United States Patent
Nishio et al.

(10) Patent No.: US 8,333,175 B2
(45) Date of Patent: Dec. 18, 2012

(54) FUEL SUPPLY SYSTEMS

(75) Inventors: Toshio Nishio, Handa (JP); Koji Yoshida, Kasugai (JP); Hideaki Nishibu, Tokai (JP); Kazumichi Hanai, Nagoya (JP); Yuichi Murakoshi, Inazawa (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 355 days.

(21) Appl. No.: 12/685,693

(22) Filed: Jan. 12, 2010

(65) Prior Publication Data

US 2010/0175666 A1 Jul. 15, 2010

(30) Foreign Application Priority Data

Jan. 13, 2009 (JP) ..... 2009-004596
Oct. 29, 2009 (JP) ..... 2009-248929

(51) Int. Cl.
*F02M 59/36* (2006.01)
*F02M 37/04* (2006.01)

(52) U.S. Cl. ..... 123/458; 123/511

(58) Field of Classification Search ..... 123/457–465; 137/509, 510, 505, 505.12, 505.14, 494
See application file for complete search history.

(56) References Cited

U.S. PATENT DOCUMENTS 4,274,380 A * 6/1981 de Vulpillieres ..... 123/456
4,522,177 A * 6/1985 Kawai et al. ..... 123/478
4,872,437 A * 10/1989 Asayama ..... 123/463
5,367,999 A * 11/1994 King et al. ..... 123/458
5,381,816 A * 1/1995 Alsobrooks et al. ..... 137/15.22
5,398,655 A * 3/1995 Tuckey ..... 123/456
5,560,340 A * 10/1996 Tomisawa ..... 123/494
5,630,399 A * 5/1997 Nomura et al. ..... 123/467
5,673,670 A * 10/1997 Powell et al. ..... 123/463
5,967,119 A * 10/1999 Burkhard et al. ..... 123/458
7,458,362 B2 * 12/2008 Hazama et al. ..... 123/457
7,717,091 B2 * 5/2010 Aoki et al. ..... 123/511
7,740,006 B2 * 6/2010 Ikeya ..... 123/506
7,878,179 B2 * 2/2011 Ikeya ..... 123/457
7,971,574 B2 * 7/2011 Kondoh ..... 123/457
2003/0047169 A1 * 3/2003 Buse et al. ..... 123/457
2010/0043755 A1 * 2/2010 Nishibu et al. ..... 123/459

FOREIGN PATENT DOCUMENTS

JP 08035459 2/1996
JP 2007278113 10/2007
JP 2008190527 8/2008

* cited by examiner

*Primary Examiner* — Thomas Moulis

(74) *Attorney, Agent, or Firm* — Dennison, Schultz & MacDonald

(57) ABSTRACT

On aspect according to the present invention includes a fuel supply system including a backflow preventing device provided in a fuel supply path communicating between a fuel pump and a fuel injecting valve device of an engine. The backflow preventing device can prevent backflow of the fuel from the fuel injecting valve device, so that a pressure of the fuel between the backflow preventing device and the fuel injecting valve device can maintained after stopping the fuel pump.

6 Claims, 18 Drawing Sheets

FUEL SUPPLY SYSTEMS

This application claims priority to Japanese patent application serial numbers 2009-004596 and 2009-248929, the contents of which are incorporated herein by reference.

BACKGROUND OF THE INVENTION

1. Field of the Invention

The present invention relates to fuel supply systems used mainly for vehicle engines, such as internal combustion engines.

2. Description of the Related Art

Japanese Laid-Open Patent Publication No. 2007-278113A discloses a known fuel supply system. FIG. 19 is a schematic diagram showing the fuel supply system disclosed in this publication. As shown in FIG. 19, a fuel supply system 112 is equipped with a fuel pump 120 supplying fuel stored in a fuel tank to fuel injection valves 104 respectively corresponding to cylinders of an engine 106. The fuel injection valves 104 are mounted to a delivery pipe 102. The fuel pump 120 pressurizes fuel introduced from a fuel inlet port 121, and discharges it through a fuel discharge port 122. The pressure of the fuel discharged by the fuel pump 120 is adjusted by a pressure regulator 140, and the fuel is thereafter supplied to the delivery pipe 102 via pipeline 300. A pipeline 300 and a back pressure chamber 310 of the pressure regulator 140 are connected to each other by a pipeline 302. The pipeline 302 is provided with a throttle portion 303. A discharge pipe 308 is connected to the portion of the pipeline 302 between the back pressure chamber 310 and the throttle portion 303. The discharge pipe 308 is provided with a throttle portion 309. An opening and closing valve 130 is installed in a portion of the pipeline 302 on the upstream side of the throttle portion 303. When the opening and closing valve 130 is opened, the discharged fuel from the fuel pump 120 is introduced into the back pressure chamber 310 via the pipeline 302. The pipeline 300 and a pressure regulating chamber 312 of the pressure regulator 140 are connected to each other by a pipeline 304. An ECU (engine control unit) 200 controls the supply of an electric power to the fuel pump 120, and also controls the supply of an electric power to the opening and closing valve 130 in accordance with the operating conditions of the engine 106.

When the fuel pump 120 is driven, the pressure of the fuel supplied to the fuel injection valves 104 from the pipeline 300 increases. In the state in which the opening and closing valve 130 is closed, the discharged fuel from the pump 120 is not introduced into the back pressure chamber 310 of the pressure regulator 140. Since the back pressure chamber 310 is open to the atmosphere, the pressure of the back pressure chamber 310 corresponds to the atmospheric pressure. The discharged fuel from the fuel pump 120 is introduced into the pressure regulating chamber 312 of the pressure regulator 140 via the pipelines 300, 304. Thus, due to a difference between a force (back pressure) F1 applied to a diaphragm of the pressure regulator 140 from within the back pressure chamber 310 and a force (fuel pressure) F2 applied to the diaphragm from within the pressure regulating chamber 312, the diaphragm deforms. And, if $F1 \geqq F2$, no fuel is discharged from the pressure regulating chamber 312. If $F1 < F2$, the fuel is discharged from the pressure regulating chamber 312 as surplus fuel. As a result, the fuel pressure in the pressure regulating chamber 312, that is, the pressure of the fuel supplied from the fuel pump 120 to the fuel injection valves 104 (which pressure may be called "system fuel pressure"), is adjusted to a low pressure.

When the opening and closing valve 130 is opened in the state in which the fuel pump 120 is being driven, the discharged fuel from the fuel pump 120 is introduced into the back pressure chamber 310 of the pressure regulator 140 from the pipeline 302. As a result, due to the pressure of the fuel introduced into the back pressure chamber, the pressure within the back pressure chamber 310 becomes to a high pressure that is higher than the atmospheric pressure. With this, the fuel pressure within the pressure regulating chamber 312, that is, the system fuel pressure, is adjusted to a high pressure. In this way, the ECU 200 controls to open or close the opening and closing valve 130 in accordance with the operating condition of the engine 106, whereby the system fuel pressure is varied.

During stopping of the engine, when the opening and closing valve 130 is closed, the ECU 200 controls to stop the operation of the fuel pump 120, and when the opening and closing valve 130 is open, the ECU 200 controls to close the opening and closing valve 130, and then to stop the operation of the fuel pump 120. Due to this arrangement, a residual pressure is maintained in the pipeline 300 through the closing of the opening and closing valve 130, the closing of the fuel injection valves 104, and the closing of a check valve (not shown) installed within the fuel discharge port 122 of the fuel pump 120. This arrangement is incorporated for suppressing generation of vapor inside the pipeline 300 when the engine is at a high temperature, and for improving the restarting property of the engine.

In the above known art (See FIG. 19), during stopping of the engine, the fuel pump 120 is stopped in the state in which the opening and closing valve 130 is closed. Thus, it is only possible to maintain in the pipeline 300 a lowered system fuel pressure as the residual pressure. Accordingly, it is impossible to maintain in the pipeline 300 a heightened system fuel pressure as the residual pressure; in particular, the suppression of vapor generation in the fuel supply path when the engine is at a high temperature is insufficient, thus leaving room for an improvement in terms of restarting property.

Therefore, there is a need in the art for a fuel supply system that is improved in the restarting property of an engine.

SUMMARY OF THE INVENTION

On aspect according to the present invention includes a fuel supply system including a backflow preventing device provided in a fuel supply path communicating between a fuel pump and a fuel injecting valve device of an engine. The backflow preventing device can prevent backflow of the fuel from the fuel injecting valve device, so that a pressure of the fuel between the backflow preventing device and the fuel injecting valve device can maintained after stopping the fuel pump.

DETAILED DESCRIPTION OF THE INVENTION

Figure 1:
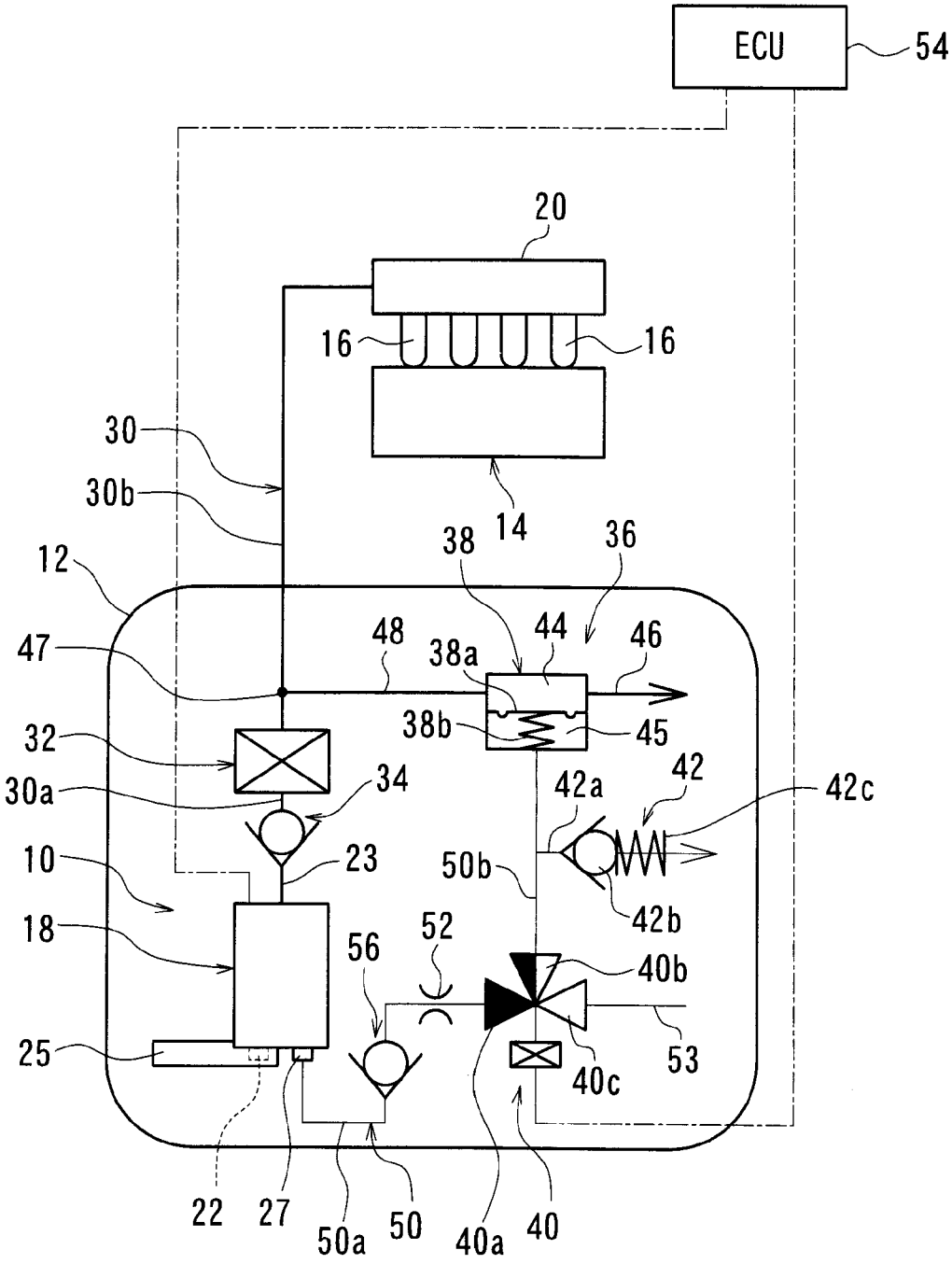
FIG. 1 is a schematic diagram showing the construction of a fuel supply system according to a first embodiment.

Each of the additional features and teachings disclosed above and below may be utilized separately or in conjunction with other features and teachings to provide improved fuel supply systems. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel supply system includes a fuel pump, a pressure regulator, a change-over device, a check valve and an outflow preventing device. The fuel pump can supply fuel stored within a fuel tank to a fuel injecting valve device. The pressure regulator includes a pressure regulating chamber, into which a part of the fuel supplied from the fuel pump to the fuel injecting valve device can be introduced, and a back pressure chamber, into which a part of the fuel pressurized by the fuel pump can be introduced. A pressure of the fuel within the pressure regulating chamber can be regulated according to a back pressure produced within the back pressure chamber, and surplus fuel not to be used within the pressure regulating chamber can be discharged from the pressure regulator. The change-over valve can change between a fuel introduction state for introducing the fuel into the back pressure chamber and an atmospheric pressure introduction state for introducing an atmospheric pressure into the back pressure chamber of the pressure regulator, so that a system fuel pressure of the fuel supplied to the fuel injecting valve device can be changed by the change-over device. The check valve is arranged in a fuel supply path leading from the fuel pump to the fuel injecting valve device and is positioned on an upstream side of a first diverting point in the fuel supply path, from which the fuel is introduced into the pressure regulating chamber of the pressure regulator. The outflow prevention device can prevent outflow of the fuel within the back pressure chamber of the pressure regulator when the engine is stopped while the system fuel pressure being heightened.

With this arrangement, when the engine is stopped while the system fuel pressure being heightened, the outflow prevention device can prevent outflow of the fuel within the back pressure chamber of the pressure regulator. Therefore, it is possible to maintain the pressure within the backflow chamber at a high level. On the other hand, because the check valve and the fuel injecting valve device are closed to maintain the heightened system pressure within the fuel supply path as a remaining pressure. Because the high level remaining pressure can be maintained within the fuel supply path, it is possible to inhibit production of fuel vapor within the fuel supply path when the engine is at a high temperature, and hence, it is possible to improve restarting property.

The fuel supply system may further include an upstream side path diverged from the fuel supply path at a second diverting point positioned on an upstream side of the check valve, so that a part of the fuel is introduced into the back pressure chamber of the pressure regulator via the upstream side path. The outflow prevention device is a check valve arranged in the upstream side path at a position on an upstream side of the change-over device and is capable of preventing backflow of the fuel. With this arrangement, it is possible to prevent outflow of the fuel from the back pressure chamber when the engine is stopped.

Alternatively the outflow preventing device may be a valve device capable of opening and closing a path leading from the back pressure chamber of the pressure regulator to the change-over device. Also with this arrangement, it is possible to prevent outflow of the fuel from the back pressure chamber when the engine is stopped.

Alternatively, the outflow preventing device may be a valve device capable of opening and closing an atmospheric side path of the change-over device. Also with this arrangement, it is possible to prevent outflow of the fuel from the back pressure chamber when the engine is stopped.

In another embodiment of the fuel supply system, a part of the fuel diverted from a first diverting point in a fuel supply path leading from the fuel pump to the fuel injecting valve device can be introduced into the pressure regulating chamber of the pressure regulator. On the other hand, a part of the fuel diverted from a second diverting point in the fuel supply path on a downstream side of the first diverting point can be introduced into the back pressure chamber. A check valve is arranged in the fuel supply path at a position on a downstream side of the second diverting point for the back pressure chamber and can prevent backflow of the fluid. A bypass path is connected to the fuel supply path to bypass the check valve. The change-over device includes a change-over valve capable of allowing flow of the fuel to bypass the first check valve when an atmospheric pressure is introduced into the back pressure chamber. The change-over valve can prevent flow of the fuel to bypass the check valve when the fuel is introduced into the back pressure chamber. The change-over valve can prevent flow of the fuel to bypass the first check valve when the engine is stopped while the system fuel pressure being heightened.

With this arrangement, when the engine is stopped, the bypath path can be blocked by change-over valve, and the check valve and the fuel injecting valve device can be closed to seal between the check valve and the fuel injecting valve device and between the change-over valve and the fuel injecting valve device. Therefore, it is possible to maintain the heightened system pressure within the fuel supply path as a remaining pressure. Because the high level remaining pressure can be maintained within the downstream path on the downstream side of the check valve of the fuel supply path, it is possible to inhibit production of fuel vapor within the fuel supply path when the engine is at a high temperature, and hence, it is possible to improve restarting property.

In a further embodiment, a check valve is arranged in the fuel supply path leading from the fuel pump to the fuel injecting valve device. The check valve is positioned on a downstream side of a diverting point in the fuel supply path, from which the fuel is introduced into the pressure regulating chamber of the pressure regulator, so that the system fuel pressure can be heightened when the engine is stopped. With this arrangement, when the engine is stopped, the check valve and the fuel injecting valve device can be closed to seal between the check valve and the fuel injecting valve device. Therefore, it is possible to maintain the heightened system pressure within the fuel supply path as a remaining pressure. Because the high level remaining pressure can be maintained within the fuel supply path, it is possible to inhibit production of fuel vapor within the fuel supply path when the engine is at a high temperature, and hence, it is possible to improve restarting property.

Various embodiments of the present invention will now be described with reference to the drawings.

First Embodiment

A first embodiment of the present invention will now be described. This embodiment relates to a fuel supply system used in a vehicle engine. FIG. 1 is a schematic diagram illustrating the fuel supply system.

Referring to FIG. 1, a fuel supply system 10 is equipped with a fuel pump 18. The fuel pump 18 can supply fuel stored in a fuel tank 12 to fuel injection valves (injectors) 16 respectively corresponding to cylinders of an engine 14. The fuel tank 12 is mounted to a vehicle (not shown). The fuel injection valves 16 are mounted to a delivery pipe 20. The fuel pump 18 may be a motor driven pump, such as a turbine type electric pump that includes a motor serving as an electric drive section and a pump section having an impeller rotatably driven by the motor for pressurizing fuel drawn into the fuel pump 18. The fuel pump 18 may be installed in the fuel tank 12. The fuel pump 18 draws the fuel in the fuel tank 12 from a fuel inlet port 22 and pressurizes the fuel before discharging it through a fuel discharge port 23. Connected to the fuel inlet port 22 is an inlet filter 25 that can filter the fuel drawn into the fuel pump 18 from within the fuel tank 12. Further, the fuel pump 18 is provided with a vapor discharge port 27 for diverting and discharging vapor (gas bubbles generated through vaporization of the fuel) that may be produced in the fuel during the pressurizing process, from a flow path defined in the pump section.

The discharged fuel from the fuel discharge port 23 of the fuel pump 18 is supplied to the delivery pipe 20 via a fuel supply path 30 extending between the interior and the exterior of the fuel tank 12. The fuel supplied to the delivery pipe 20 is injected from the fuel injection valves 16 into the respective combustion chambers (not shown) of the cylinders of the engine 14. In the upstream portion of the fuel supply path 30 on the side of the fuel discharge port 23, there is provided a fuel filter 32 for filtering the fuel. The fuel filter 32 is arranged inside the fuel tank 12. Further, the fuel discharge port 23 of the fuel pump 18 has a check valve 34 disposed therein for preventing backflow of the fuel. The check valve 34 may be of a ball valve type. In this embodiment, the vapor discharge port 27 serves as a part of a fuel path on the upstream side of the check valve 34.

The system fuel pressure of the fuel supplied to the fuel injection valves 16 can be varied by a fuel pressure varying device 36. The fuel pressure varying device 36 is equipped with a pressure regulator 38, a change-over valve 40, and a relief valve 42.

The pressure regulator 38 has a pressure regulating chamber 44 and a back pressure chamber 45. The pressure regulator 38 can adjust the fuel pressure in the pressure regulating chamber 44 according to the back pressure of the back pressure chamber 45 and can discharge a portion of the fuel that has become surplus in the pressure regulating chamber 44 (hereinafter called "surplus fuel" or "return fuel") via a return fuel path 46. Further, the pressure regulator 38 is equipped with a diaphragm 38*a* separating the pressure regulating chamber 44 and the back pressure chamber 45 from each other, and a spring 38*b* arranged inside the back pressure chamber 45 and urging the diaphragm 38*a*. The pressure regulator 38 may have the same construction as the pressure regulator disclosed in JP 2007-278113A referred to in the background art.

The pressure regulating chamber 44 communicates with a pressure regulating and introduction path 48 branching off from a diverting point 47 near the downstream side of the fuel filter 32 in the fuel supply path 30. As a result, a portion of the fuel supplied from the fuel pump 18 to the fuel injection valves 16 is introduced into the pressure regulating chamber 44 via the pressure regulating and introduction path 48. The portion of the fuel supply path 30 on the upstream side of the diverting point 47 (inclusive of the fuel discharge port 23 and the fuel filter 32) will be referred to as an upstream side path 30*a*, and the portion thereof on the downstream side of the diverting point 47 will be referred to as a downstream side path 30*b*.

The vapor discharge port 27 of the fuel pump 18 communicates with the back pressure chamber 45 via a back pressure introduction path 50. As a result, a portion of the fuel pressurized by the fuel pump 18 is introduced into the back pressure chamber 45 via the back pressure introduction path 50.

The change-over valve 40 consists of an electromagnetic drive type three-way valve, and has three ports 40*a*, 40*b*, and 40*c*. When no electric power is supplied to the valve 40, the first port 40*a* is closed, and the second port 40*b* and the third port 40*c* communicate with each other. When the power is supplied, the first port 40*a* and the second port 40*b* communicate with each other, and the third port 40*c* is closed. The change-over valve 40 is provided in the back pressure introduction path 50. That is, the back pressure introduction path 50 is divided into an upstream side path 50*a* and a downstream side path 50*b*. The downstream end of the upstream side path 50*a* is connected to the first port 40*a*, and the upstream end of the downstream side path 50*b* is connected to the second port 40*b*. In the upstream side path 50*a*, there is provided a throttle portion 52 restricting the amount of fuel introduced into the back pressure chamber 45. The third port 40*c* is open to the atmosphere via an atmospheric pressure path 53. The turning ON/OFF of supply of power to the change-over valve 40 is controlled by an electronic control unit (hereinafter referred to as "ECU") 54. The change-over valve 40 and the ECU 54 constitute a change-over device.

The ECU 54 includes a CPU, a ROM, and a RAM. Through execution of a control program stored in the ROM by the CPU, the ECU 54 turns on/off the supply of electric power to the fuel pump 18 in accordance with the operating condition of the engine 14, whereby the driving of the fuel pump 18 is controlled. In addition, the ECU turns on/off the supply of electric power to the change-over valve 40 for a change-over control of the change-over valve 40. In this way, the ECU 54 serves as a control device.

The relief valve 42 is equipped with a relief flow path 42*a* branching off from the upstream side path 50*b*, a valve member 42*b* consisting of a ball valve capable of opening/closing the relief flow path 42*a*, and a return spring 42*c* pressing the valve member 42*b* in a closing direction. When the fuel pressure in the back pressure chamber 45 becomes higher than the resilient force of the return spring 42*c*, the valve member 42*b* of the relief valve 42 is opened against the resilient force of the return spring 42*c* and allows the fuel in the back pressure chamber 45 to be relieved via the relief flow path 42*a*. When the fuel pressure in the back pressure chamber 45 becomes lower than a set valve, the valve member 42*b* is closed by the resilient force of the return spring 42*c*. Thus, the fuel pressure in the back pressure chamber 45 is maintained at a set pressure by the relief valve 42.

In the upstream side path 50*a* of the back pressure introduction path 50, there is provided a check valve 56 preventing backflow of the fuel. The check valve 56 may be a ball valve type check valve. The check valve 56 is arranged on the upstream side of the throttle portion 52. The check valve 56 serves as an outflow prevention device as will be explained later. The upstream side path 50*a* of the back pressure introduction path 50 serves as a path leading to the change-over device (more specifically, the change-over valve) from the path portion (the vapor discharge port 27) on the upstream side of the check valve 34. Next, the operations of the fuel supply system 10 will be described.

(Operations at Time of Starting Engine and During Normal Operation of Engine)

The operations at the time of starting the engine 14 and during a normal operation of the engine 14 will be described.

In accordance with the operating condition of the engine 14, the ECU 54 determines to set the pressure of the fuel injected by the fuel injection valves 16 (the system fuel pressure) to a high pressure or a low pressure. For example, at the time of starting the engine 14, it is desirable to set the system fuel pressure to a high pressure in order to promote the atomization of the fuel mist under a low temperature condition, and in order to promote the atomization of the fuel mist and prevent generation of vapor under a high temperature condition. If the load of the engine 14 is low as in the case of constant-speed traveling of the vehicle, the system fuel pressure may be set to a low pressure. And, through change-over control of the change-over valve 40 by the ECU 54, switching between a high system fuel pressure and a low system fuel pressure is effected.

That is, at the time of starting the engine 14, if the fuel pump 18 is driven without the supply of electric power to the change-over valve 40, the system fuel pressure of the fuel supplied to the fuel injection valves 16 through the fuel supply path 30 is increased. At this time, in the state in which no electric power is supplied to the change-over valve 40, the back pressure introduction path 50 is blocked, so that the fuel (vapor fuel) pressurized in the pump section of the fuel pump 18 is not introduced into the back pressure chamber 45 of the pressure regulator 38. The back pressure chamber 45 is open to the atmosphere via the downstream side path 50*b* of the back pressure introduction path 50 and the atmospheric pressure path 53, so that the pressure in the back pressure chamber 45 corresponds to the atmospheric pressure. The fuel discharged from the fuel pump 18 is introduced into the pressure regulating chamber 44 of the pressure regulator 38 via the pressure regulating and introduction path 48 diverted from a midpoint in the fuel supply path 30. Thus, the diaphragm 38*a* in the pressure regulator 38 is deformed or displaced due to a difference between the force (back pressure) F1 received from within the back pressure chamber 45 and the force (system fuel pressure) F2 received from within the pressure regulating chamber 44. Here, the pressure in the back pressure chamber 45 corresponds to the atmospheric pressure, so that the back pressure F1 of the back pressure chamber 45 consists solely of the spring load of the spring 38*b*. And, if $F1 \geqq F2$, the fuel in the pressure regulating chamber 44 is not discharged via the return fuel path 46. If $F1 < F2$, the fuel of the pressure regulating chamber 44 is discharged as surplus fuel, i.e., so-called return fuel, via the return fuel path 46, whereby the system fuel pressure is reduced to the set value. As a result, the system fuel pressure is adjusted to a low pressure.

If, with the fuel pump 18 being driven, the power is supplied to the change-over valve 40, communication is established between the upstream side path 50*a* and the downstream side path 50*b* of the back pressure introduction path 50, so that the fuel pressurized (vapor fuel) in the pump section of the fuel pump 18 is introduced into the back pressure chamber 45 of the pressure regulator 38 via the back pressure introduction path 50. Further, communication between the downstream side path 50*b* of the back pressure introduction path 50 and the atmospheric pressure path 53 is blocked, so that the fuel in the back pressure chamber 45 is not discharged via the atmospheric pressure path 53. Thus, the fuel pressure due to the vapor fuel is exerted inside the back pressure chamber 45, so that the pressure inside the back pressure chamber 45 becomes higher than the atmospheric pressure. That is, the back pressure (F1) of the back pressure chamber 45 is the sum of the spring load of the spring 38*b* and the fuel pressure exerted in the back pressure chamber 45. With this, the fuel pressure of the pressure regulating chamber 44, that is, the system fuel pressure, is adjusted to a high pressure. At this time, the fuel pressure 45 in the back pressure chamber 45 is controlled to the set pressure by the relief valve 42.

Next, if the supply of electric power to the change-over valve 40 is interrupted, the back pressure introduction path 50 is blocked as described above, and communication is established between the downstream side path 50*b* of the back pressure introduction path 50 and the atmospheric pressure path 53, so that the fuel in the back pressure chamber 45 is discharged via the downstream side path 50*b* and the atmospheric pressure path 53. Therefore, the pressure of the back pressure chamber 45 is brought to correspond to the atmospheric pressure. As a result, the system fuel pressure is adjusted to a low pressure.

In this way, the ECU 54 performs the change-over control of the change-over valve 40 in accordance with the operating condition of the engine 14, so that the system fuel can be switched or varied between a high pressure and a low pressure.

(Operation at Time of Stopping Engine)

Figure 2:
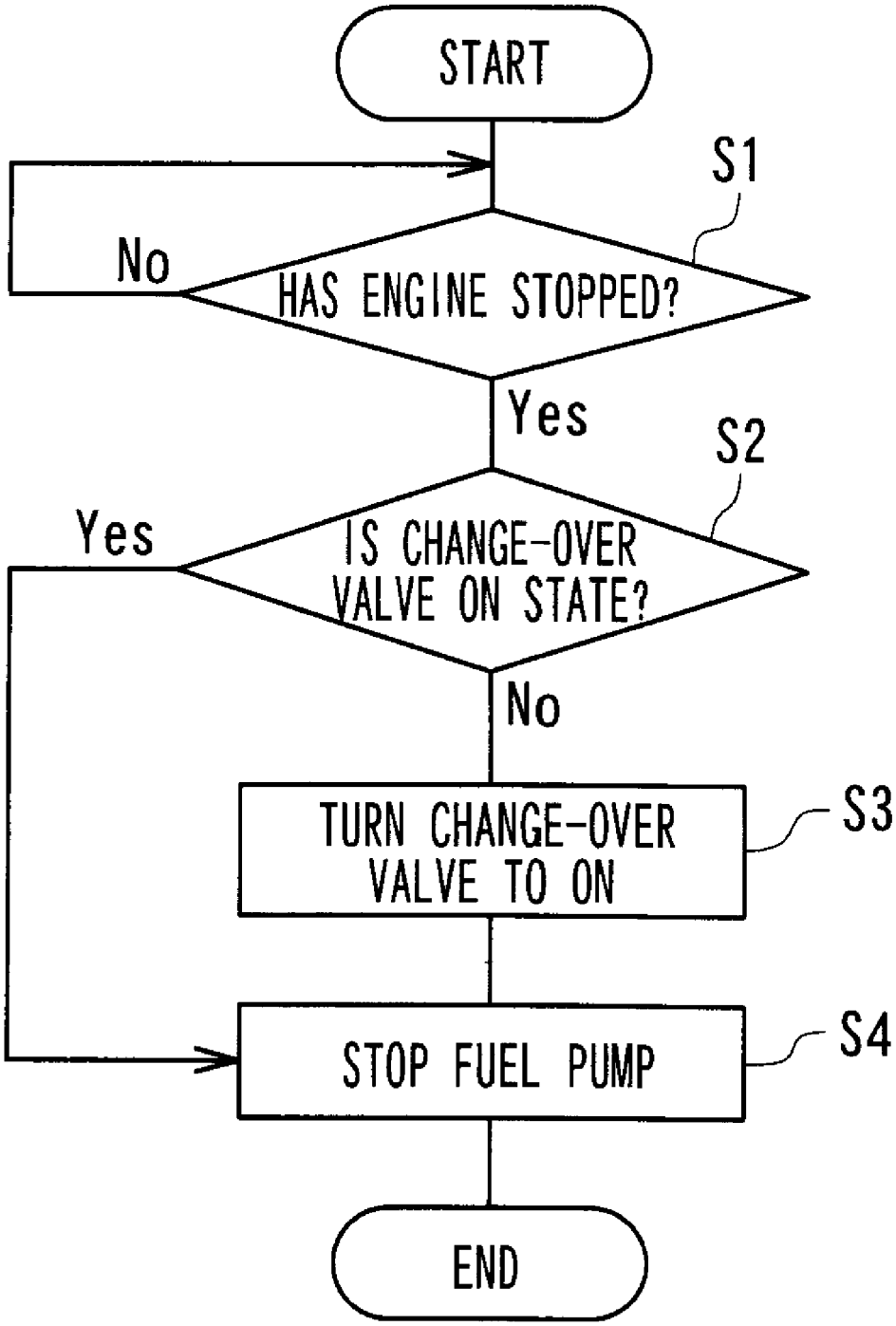
FIG. 2 is a flowchart illustrating a control operation related to a fuel pump and a change-over valve at the time of engine stop.
Figure 3:
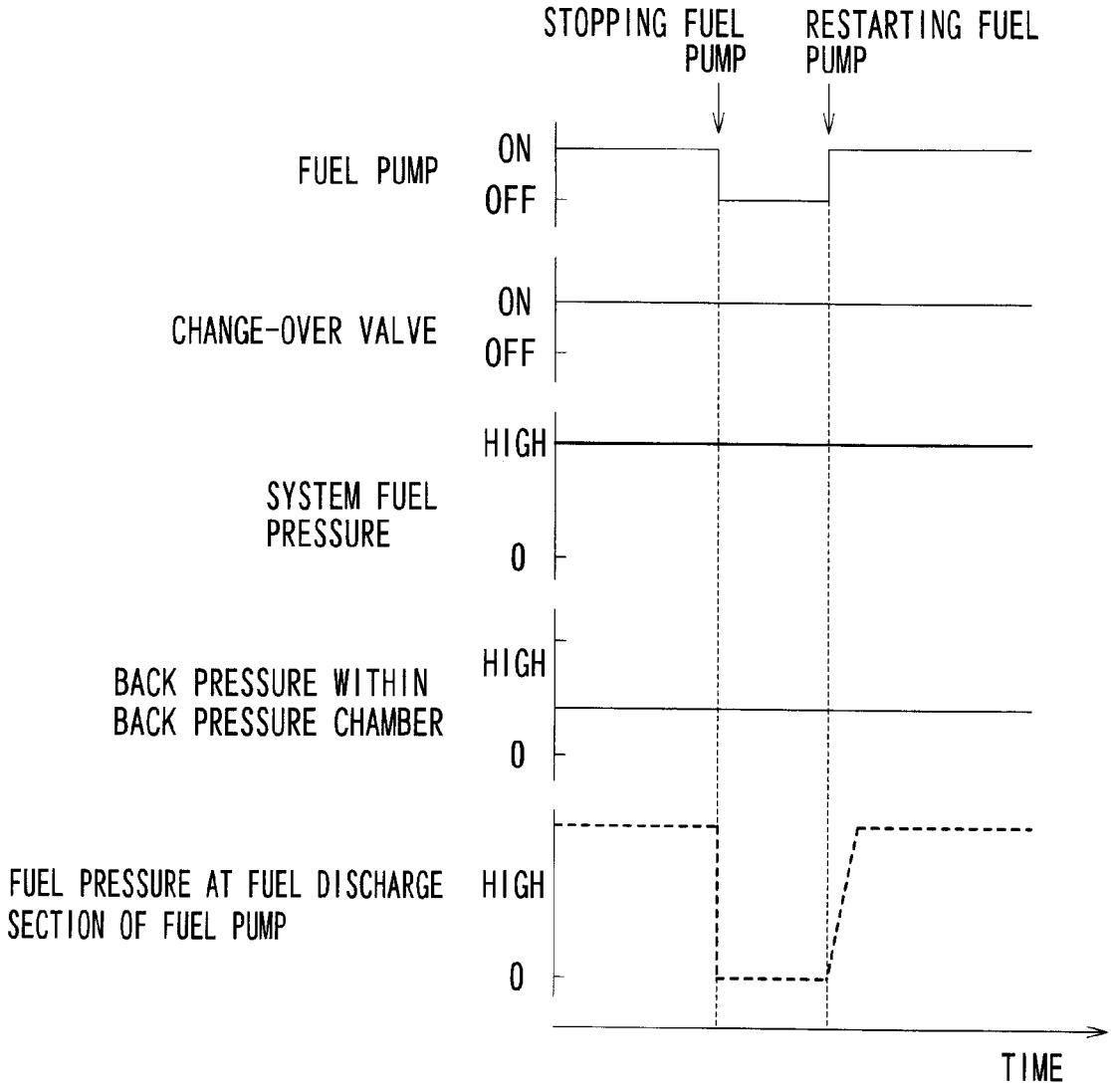
FIG. 3 is a time chart illustrating changes in fuel pressure at the time of engine stop.

The operation at the time of stopping the engine 14 will be described. FIG. 2 is a flowchart illustrating a control process related to the fuel pump and the change-over valve at the time when stopping the engine, and FIG. 3 is a time chart illustrating changes in fuel pressure when the engine is stopped. In FIG. 3, the horizontal axis indicates time, and the vertical axis indicates the ON/OFF state of the fuel pump 18, the ON/OFF state of the change-over valve 40, the state of the system fuel pressure, the state of the back pressure of the back pressure chamber 45, and the fuel pressure of the fuel discharge section (a portion of the fuel discharge port 23 on the upstream side of the check valve 34) of the fuel pump 18, in that order as from above. In this specification, the ON state of the fuel pump 18 is used to mean the state where the electric power is supplied to the motor of the fuel pump 18, and the OFF state of the fuel pump 18 is used to mean the state where no electric power is supplied to the motor. Similarly, the ON state of the change-over valve 40 is used to mean the state where the electric power is supplied to the change-over valve 40, and the OFF state of the change-over valve 40 is used to mean the state where no electric power is supplied to the change-over valve 40.

As shown in FIG. 2, in step S1, the ECU 54 determines as to whether the engine 14 is to be stopped or not. If the engine 14 is to be stopped, the ECU 54 determines, in step S2, the ON/OFF state regarding to the supply of power to the change-over valve 40. If it is determined that the change-over valve 40 is in the ON state, the ECU 54 turns the fuel pump 18 to the OFF state in step S4 to stop the fuel pump 18. In this way, when the pump 18 stops in the state in which the change-over valve 40 is the ON state, that is, in the state in which the system fuel pressure has been heightened, the check valve 56 of the upstream side path 50*a* of the back pressure introduction path 50 is closed, whereby the outflow route for the fuel in the back pressure chamber 45 of the pressure regulator 38 to the fuel pump 18 side is blocked. In the state in which the change-over valve 40 is the ON state, communication between the downstream side path 50*b* of the back pressure introduction path 50 is blocked, so that the outflow route for the fuel in the back pressure chamber 45 to the atmosphere side is also blocked. Thus, the back pressure of the back pressure chamber 45 is maintained at a high level, so that it is possible to prevent reduction in the fuel pressure of the pressure regulating chamber 44 (i.e., the system fuel pressure) (See FIG. 3). On the other hand, in the fuel supply path 30, by closing the check valve 34 of the fuel discharge port 23 of the fuel pump 18 and by closing the fuel injection valves 16, the valves 34 and 16 are sealed from each other, so that it is possible to maintain a heightened system fuel pressure in the fuel supply path 30 as the residual pressure (See FIG. 3). Thus, by maintaining the high residual pressure in the fuel supply path 30, it is possible to suppress generation of vapor in the fuel supply path 30 when the engine is at a high temperature. As the fuel pump 18 is stopped, the fuel pressure of the fuel discharge section of the fuel pump 18 is reduced to "0" (See FIG. 3).

If it is determined in step S2, that the change-over valve 40 is the OFF state, the ECU 54 turns the change-over valve 40 to the ON state in step S3 to heighten the system fuel pressure, and then the ECU turns the fuel pump 18 to the OFF state in step S4 to stop the pump 18. As a result, as in the above case, the back pressure of the back pressure chamber 45 of the pressure regulator 38 is maintained at a high level to prevent reduction in the fuel pressure of the pressure regulating chamber 44 (i.e., the system fuel pressure), and, at the same time, in the fuel supply path 30, the check valve 34 of the fuel discharge port 23 of the fuel pump 18 is closed, and the fuel injection valves 16 are closed. Therefore, the valves 34 and 16 are sealed from each other, so that it is possible to maintain in the fuel supply path 30 a heightened system fuel pressure as the residual pressure (See FIG. 3). Thus, by maintaining a high residual pressure in the fuel supply path 30, it is possible to suppress generation of vapor in the fuel supply path 30 when the engine is at a high temperature.

When the fuel pump 18 is stopped, with the change-over valve 40 being the OFF state, the fuel pump 18 is stopped with the system fuel pressure remaining low, so that, while a low residual pressure is maintained in the fuel supply path 30, it is impossible to maintain a heightened system fuel pressure as the residual pressure. In view of this, if the change-over valve 40 is the OFF state, the change-over valve 40 is turned to the ON state as described above before the fuel pump 18 is stopped, whereby it is possible to maintain the back pressure of the back pressure chamber 45 of the pressure regulator 38 at a high level to prevent reduction in the fuel pressure of the pressure regulating chamber 44, and it is possible to maintain a heightened system fuel pressure in the fuel supply path 30 as the residual pressure, making it possible to suppress generation of vapor in the fuel supply path 30 when the engine is at a high temperature. After the engine 14 and the fuel pump 18 have been stopped, the ECU 54 maintains the ON state of the change-over valve 40 as long as the engine remains at a high temperature. The period of time that the ECU 54 maintains the ON state of the change-over switch 40 is, for example, a period of time required for the engine 14 to attain a low temperature after the stopping of the engine 14 and the fuel pump 18 and for generation of no or substantially no vapor in the fuel supply path 30. After the engine has been cooled to a low temperature state, the ECU 54 turns the change-over valve 40 to the OFF state.

(Operation at Time of Restarting Engine)

The operation at the time of restarting the engine 14 while the engine 14 being at a high temperature will be described. If the engine 14 is stopped while the engine 14 being at a high temperature, the system fuel pressure is maintained at a high pressure as described above (See FIG. 3). Thus, generation of vapor in the fuel supply path 30 caused when the engine is at high temperature is suppressed, whereby it is possible to achieve an improvement in terms of the restarting property of the engine 14. The other operation is the same as that at the time of starting the engine.

According to the fuel supply system 10 described above, the system fuel pressure is heightened at the time of stopping the engine, and, in this state, the check valve 56 is closed to thereby prevent outflow (backflow) of the fuel in the back pressure chamber 45 of the pressure regulator 38, whereby the back pressure of the back pressure chamber 45 is maintained at a high level. On the other hand, by closing the check valve 34 in the fuel supply path 30 and by closing the fuel injection valves 16, the valves 34 and 16 is sealed from each other, whereby it is possible to maintain a heightened system fuel pressure in the fuel supply path 30 as the residual pressure. Thus, by maintaining a high residual pressure in the fuel supply path 30, it is possible to suppress generation of vapor in the fuel supply path 30 cause when the engine is at a high temperature, making it possible to achieve an improvement in terms of restarting property.

Further, the check valve 56 provided in the path from the vapor discharge port 27 to the change-over valve 40 of the change-over device, that is, the upstream side path 50*a* of the back pressure introduction path 50, is closed at the time of stopping the engine 14, whereby it is possible to prevent outflow (backflow) of the fuel in the back pressure chamber 45 of the pressure regulator 38.

Second Embodiment

Figure 4:
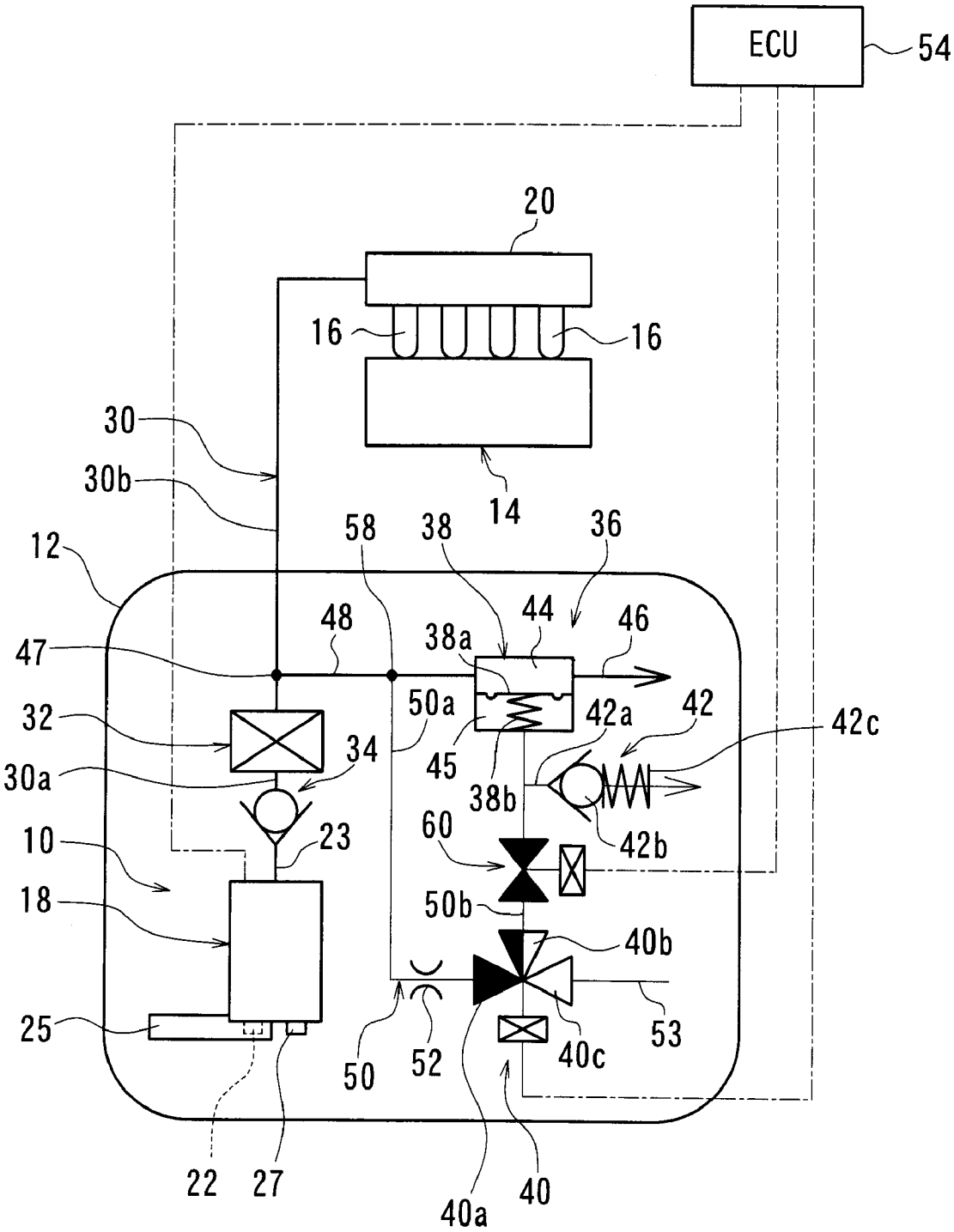
FIG. 4 is a schematic diagram showing the construction of a fuel supply system according to a second embodiment.
Figure 5:
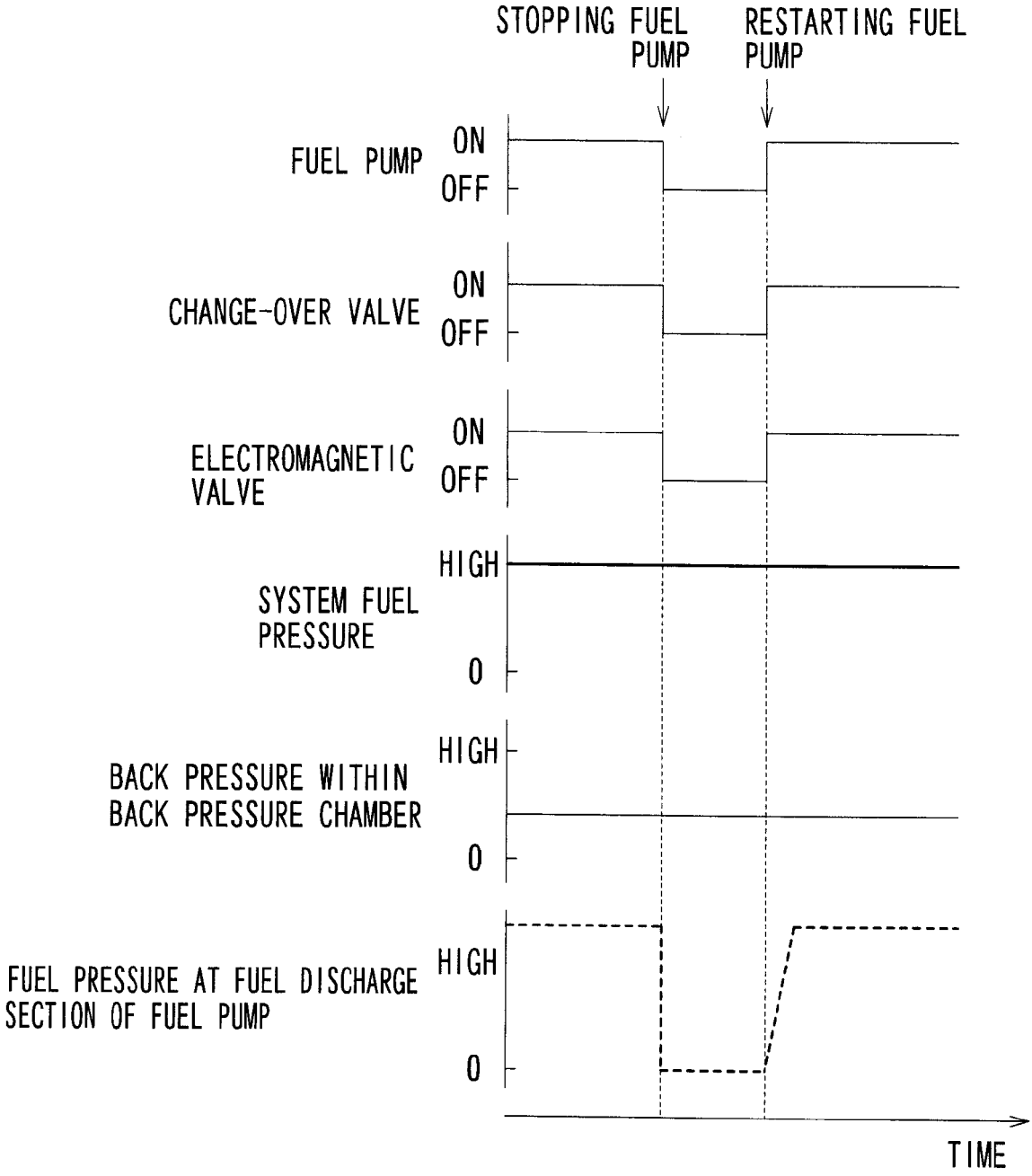
FIG. 5 is a time chart illustrating changes in fuel pressure at the time of engine stop.

A second embodiment of the present invention will now be described with reference to FIGS. 4 and 5. Since this embodiment is obtained by partially modifying the first embodiment described above, members that are the same or similar to the members of the first embodiment are labeled with the same reference numerals as the first embodiment and an explanation of these members will not be repeated. FIG. 4 is a schematic diagram showing the construction of a fuel supply system of the second embodiment.

As shown in FIG. 4, in this embodiment, the upstream side end portion of the upstream side path 50*a* of the back pressure introduction path 50 of the first embodiment (See FIG. 1) described above is connected to the diverting portion (indicated by numeral 58) of the pressure regulating and introduction path 48 instead of connecting it to the vapor discharge port 27 of the fuel pump 18. As result, a portion of the fuel (pressurized fuel) flowing through the pressure regulating and introduction path 48 is introduced into the back pressure chamber 45 via the back pressure introduction path 50. The check valve 56 of the upstream side path 50*a* of the back pressure introduction path 50 of the first embodiment is omitted.

Further, in the downstream side path 50*b* of the back pressure introduction path 50, there is provided an electromagnetic valve 60 at a position between the second port 40*b* of the change-over valve 40 and the relief valve 42. The electromagnetic valve 60 may be an opening and closing valve that is electromagnetically driven and is closed when no electric power is supplied (OFF state) and is opened when an electric power is supplied (ON state). The turning ON/OFF of the electromagnetic valve 60 is controlled by the ECU 54. The electromagnetic valve 60 and the ECU 54 may constitute a valve device. This valve device serves to open and close the path from the back pressure chamber 45 of the pressure regulator 38 to the change-over valve 40 of the change-over device, and may called as an outflow prevention device. The downstream side path 50*b* of the back pressure introduction path 50 may serve as a path from the back pressure chamber 45 of the pressure regulator to the change-over device (more specifically, the change-over valve 40).

Next, the operations of the fuel supply system 10 of the second embodiment will be described.

(Operations at Time of Starting Engine and During Normal Operation of Engine)

At the time of starting the engine 14 and during the normal operation of the engine 14, in order to set the system fuel pressure to a low pressure in accordance with the operating condition of the engine 14, the ECU 54 turns the change-over valve 40 to the OFF state and turns the electromagnetic valve 60 to the ON state. As a result, as in the first embodiment, the system fuel pressure is adjusted to a low pressure. In order to set the system fuel pressure to a high pressure in accordance with the operating condition of the engine 14, the ECU 54 turns the change-over valve 40 to the ON state, and turns the electromagnetic valve 60 to the ON state. As a result, as in the first embodiment, the system fuel pressure is adjusted to a high pressure. In this way, the system fuel pressure can be changed to a high pressure or a low pressure. During a predetermined period after starting the engine 14 and during the normal operation, the ECU 54 maintains the ON state of the electromagnetic valve 60.

(Operation at Time of Stopping Engine)

The operation at the time of stopping the engine 14 will be described. FIG. 5 is a time chart illustrating changes in the fuel pressure when the engine 14 is stopped and after the engine 14 has been stopped. In FIG. 5, the horizontal axis indicates time, and the vertical axis indicates the ON/OFF state of the fuel pump 18, the ON/OFF state of the change-over valve 40, the ON/OFF state of the electromagnetic valve 60, the state of the system fuel pressure, the state of the back pressure of the back pressure chamber 45, and the fuel pressure of the fuel discharge portion (the portion of the fuel discharge port 23 on the upstream side of the check valve 34) of the fuel pump 18, in this order as from above.

When the engine 14 is stopped, as in the first embodiment, the ECU 54 turns the electromagnetic valve 60 to the OFF state, with the system fuel pressure heightened, and then turns the fuel pump 18 to the OFF state to stop the fuel pump 18. As a result, the back pressure of the back pressure chamber 45 of the pressure regulator 38 is maintained at a high level to prevent reduction in the fuel pressure of the pressure regulating chamber 44 (i.e., the system fuel pressure), and, at the same time, in the fuel supply path 30, the check valve 34 of the fuel discharge port 23 of the fuel pump 18 and the fuel injection valves 16 are closed, whereby the valves 34 and 16 are sealed from each other, making it possible to maintain a heightened system fuel pressure in the fuel supply path 30 as the residual pressure (See FIG. 5). Thus, a high residual pressure is maintained in the fuel supply path 30, thereby making it possible to suppress generation of vapor in the fuel supply path 30 when the engine is at a high temperature.

(Operation at Time of Restarting Engine)

The operation at the time of restarting the engine 14 while the engine 14 being at a high temperature will be described. During stopping of the engine 14, the system fuel pressure is maintained at a high level as described above (See FIG. 5). Thus, generation of vapor in the fuel supply path 30 caused when the engine is at high temperature is suppressed, thereby achieving an improvement in terms of the restarting property of the engine 14. The other operation is the same as that when starting the engine.

The fuel supply system 10 of this embodiment can also provide the same effects as those of the first embodiment.

Further, the electromagnetic valve 60, which can open and close the path from the back pressure chamber 45 of the pressure regulator 38 to the change-over valve 40, that is, the downstream side path 50*b* of the back pressure introduction path 50, is closed when the engine 14 is stopped, thereby making it possible to prevent outflow of the fuel in the back pressure chamber 45 of the pressure regulator 38.

Figure 6:
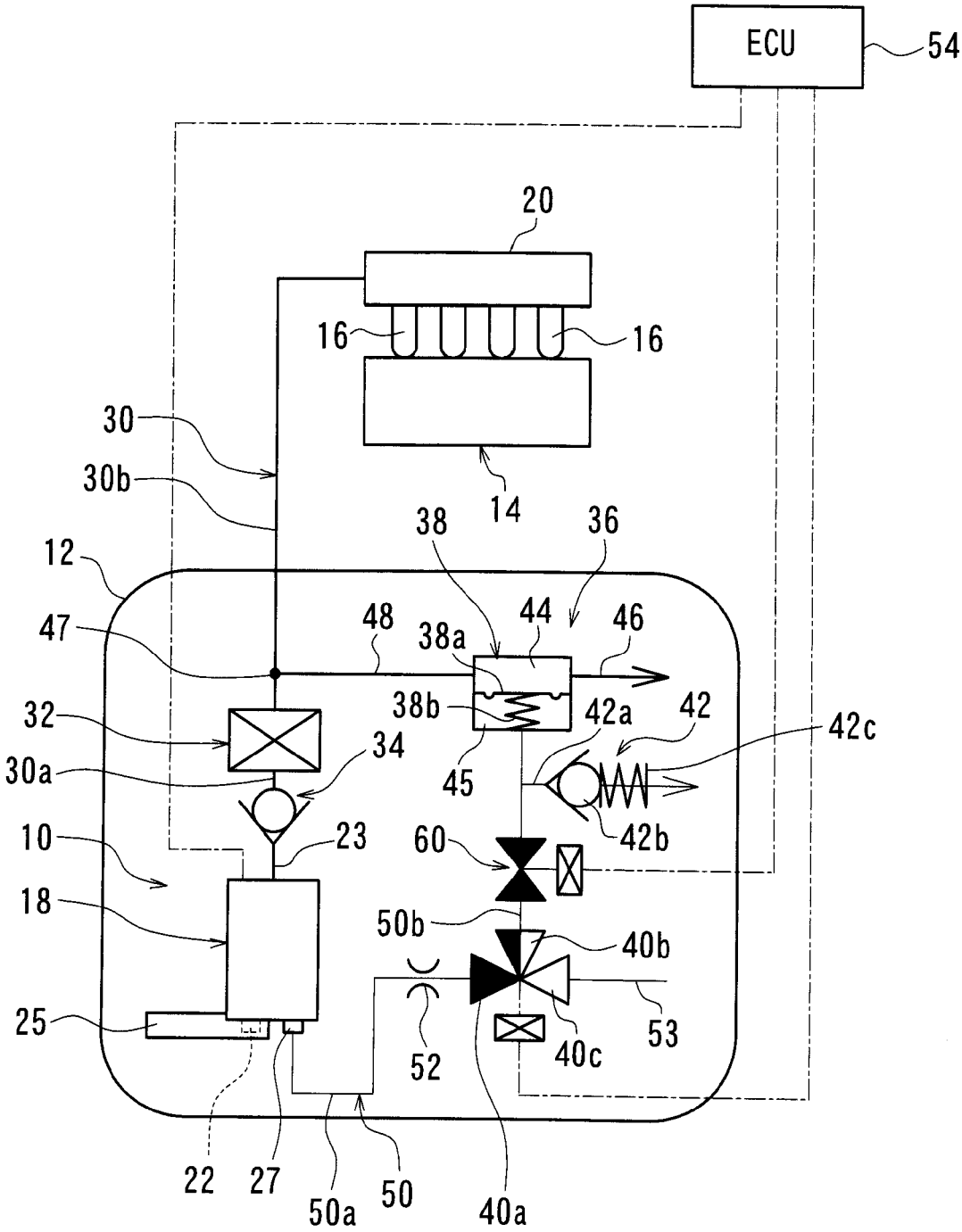
FIG. 6 is a schematic diagram showing the construction of a fuel supply system according to a modification of the second embodiment.

In an alternative embodiment, as shown in FIG. 6, the upstream side end portion of the upstream side path 50*a* of the back pressure introduction path 50 may also be connected to the vapor discharge port 27 of the fuel pump 18 instead of being connected to the diverting portion 58 of the pressure regulating and introduction path 48.

Third Embodiment

Figure 7:
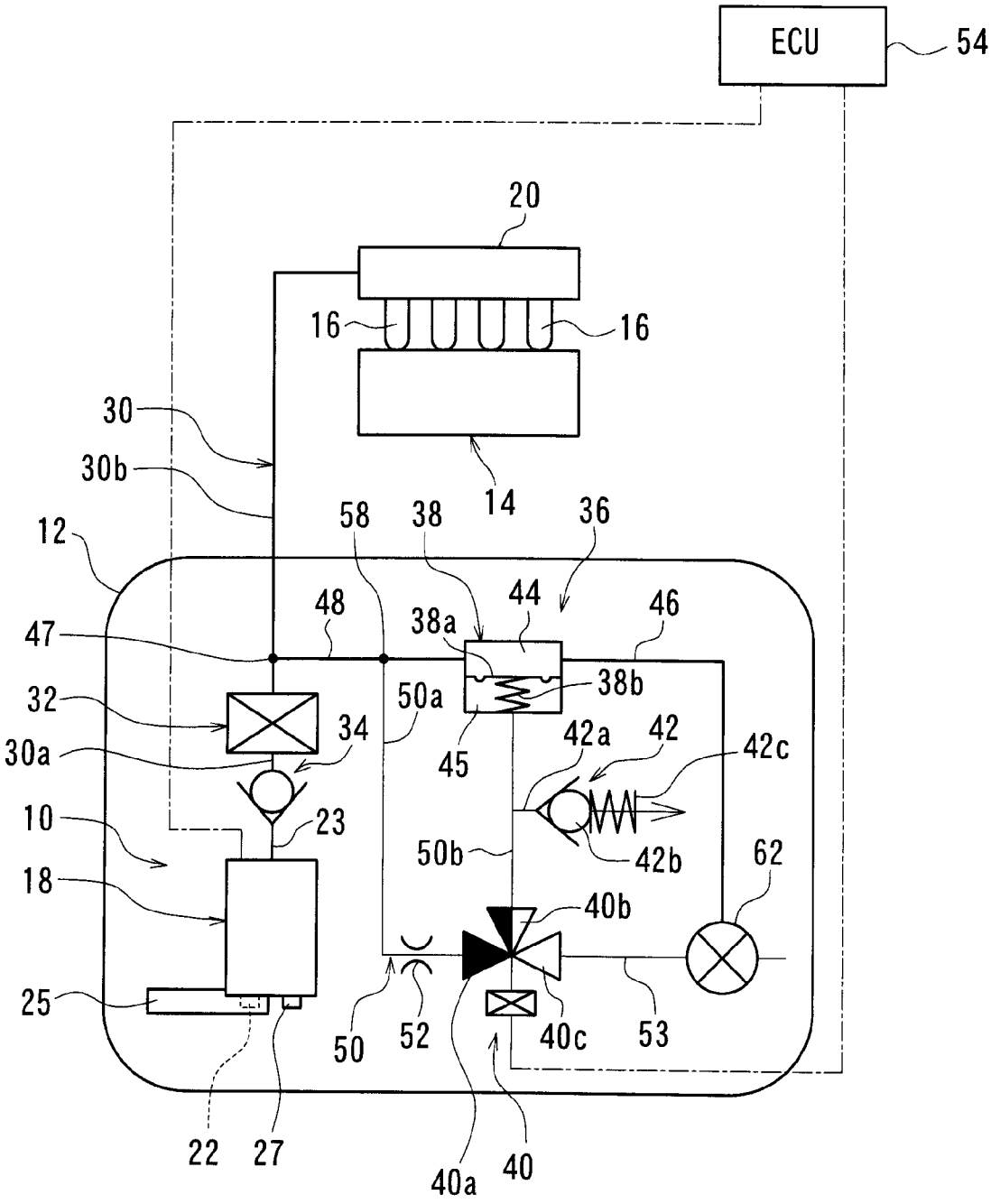
FIG. 7 is a schematic diagram showing the construction of a fuel supply system according to a third embodiment.

A third embodiment of the present invention will be described. Since this embodiment is realized by partially modifying the second embodiment, the following description will be focused mainly on the modified portion. FIG. 7 is a schematic diagram showing the construction of a fuel supply system of the third embodiment.

As shown in FIG. 7, in this embodiment, the electromagnetic valve 60 of the second embodiment (See FIG. 4) is omitted, and a fluid valve 62 is provided in the atmospheric pressure path 53. The fluid valve 62 may be an opening and closing valve driven by a fluid pressure. In this embodiment fluid valve 62 is opened and closed by the pressure of surplus fuel (return fuel) discharged from the pressure regulating chamber 44 of the pressure regulator 38 via the return fuel path 46. The fluid valve 62 is a valve device that can open and close the atmospheric pressure side path (the atmospheric pressure path 53) of the change-over valve 40 of the change-over device, and may be called as an outflow prevention device. The atmospheric pressure path 53 may serve as an atmospheric pressure side path.

Figure 8:
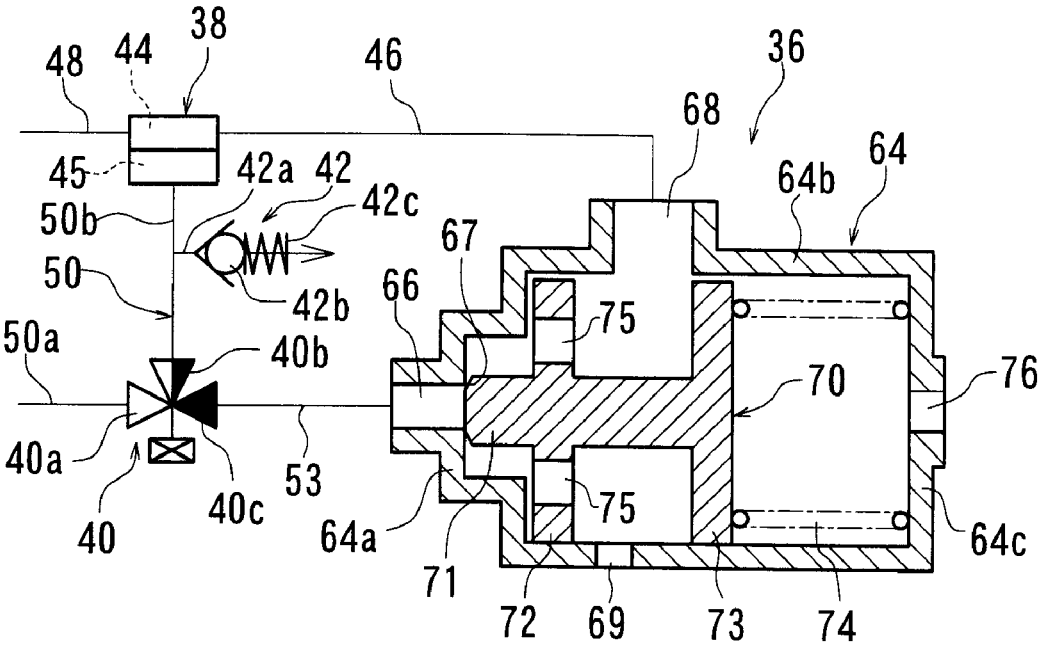
FIG. 8 is a sectional view of a fluid valve in a closed state.
Figure 9:
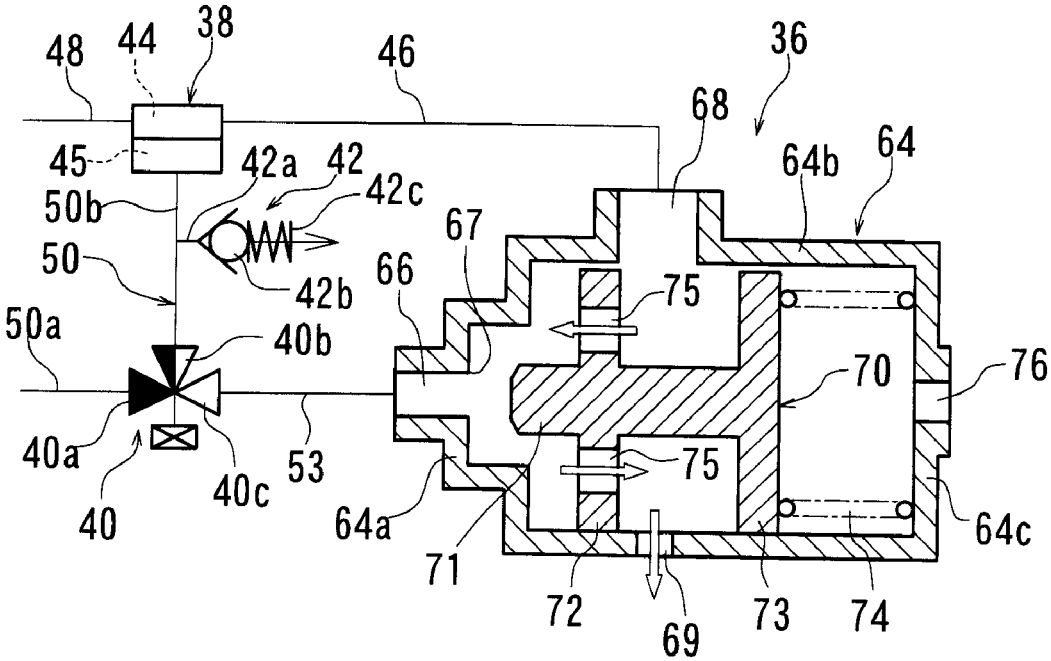
FIG. 9 is a sectional view of the fluid valve in an open state.

The fluid valve 62 will be described in detail. FIG. 8 is a sectional view of the fluid valve 62 as closed, and FIG. 9 is a sectional view of the fluid valve 62 in the open state.

As shown in FIG. 8, the fluid valve 62 has a valve housing 64 in the form of a hollow cylinder defining a valve chamber. A valve hole 66 is formed in an end wall portion 64*a* at one end side (the left-hand end side as viewed in FIG. 8) of the valve housing 64. A valve seat 67 is formed at the inner end side opening edge of the valve hole 66. Further, formed in the peripheral wall portion 54*b* of the valve housing 64 are a fuel introduction port 68 and a fuel discharge port 69 establishing communication between the interior and the exterior of the valve housing 64. The opening area of the fuel discharge port 69 is set to be smaller than the opening area of the fuel introduction port 68. Further, in the valve housing 64, that is, in the valve chamber, there is provided a valve body 70 that can move in the axial direction (the left and right direction as viewed in FIG. 8). Further, in an end wall portion 64*c* at the other end side (the right-hand end side as viewed in FIG. 8) of the valve housing 64, there is formed an atmosphere port 76 opening the interior of the valve housing 64, i.e., the valve chamber, to the atmosphere.

The valve body 70 has a valve shaft 71 that can come into and out of contact with the valve seat 67, and a pair of front and rear flange portions 72 and 73 protruding from the outer periphery of the valve shaft 71. The flange portions 72 and 73 are formed so as to be slidable along the inner peripheral surface of the valve housing 64. A return spring 74 is provided between the flange portion 73 at the rear side (the right-hand side as viewed in FIG. 8) of the valve shaft 71 and the end wall portion 64*c* of the valve housing 64 opposed thereto. The return spring 74 normally urges the valve body 70 forwards (to the left as viewed in FIG. 8). The flange portion 72 at the front side (the left-hand side as viewed in FIG. 8) of the valve shaft 71 has a suitable number of (two, in the embodiment shown in FIG. 8) communication holes 75 extending therethrough in the thickness direction (the left and right direction as viewed in FIG. 8). The valve body 70 is opened and closed within such a range that a space between the flange portions 72 and 73 communicates with the fuel introduction port 68 and the fuel discharge port 69. The downstream side end portion of the atmospheric pressure path 53 is connected to the valve hole 66. The downstream side end portion of the return fuel path 46 is connected to the fuel introduction port 68.

With the fluid valve 62, when no surplus fuel (return fuel) is discharged from the pressure regulating chamber 44 of the pressure regulator 38, the valve body 70 closes, that is, the valve shaft 71 is held in contact with the valve seat 67, by the resiliency of the return spring 74 as shown in FIG. 8, whereby the atmospheric pressure path 53 is closed.

When return fuel is discharged from the pressure regulating chamber 44 of the pressure regulator 38, the return fuel is introduced into the space between the flange portions 72 and 73 of the valve body 70 in the valve housing 64 via the return fuel path 46. Then, as shown in FIG. 9, a part of the return fuel is discharged through the fuel discharge port 69, and the remainder passes through the communication holes 75 of the flange portion 72, and flows into the space between the end wall portion 64*a* of the valve housing 64 and the flange portion 72. Due to the pressure of this return fuel, the valve body 70 opens against the resiliency of the return spring 74, that is, the valve shaft 71 is separated from the valve seat 67, whereby the atmospheric pressure path 53 is opened.

The return fuel having flowed into a space defined between the end wall portion 64*a* of the valve housing 64 and the flange portion 72 passes through the communication holes 75 of the flange portion 72, and returns to the space between the flange portions 72 and 73. Therefore, the return fuel is not discharged through the fuel discharge port 69. When the discharge of the return fuel from the pressure regulating chamber 44 of the pressure regulator 38 is stopped, the valve body 70 closes due to the resiliency of the return spring 74 (See FIG. 8). Next, the operation of the fuel supply system 10 of the third embodiment will be described.

(Operations at Time of Starting Engine and During Normal Operation of Engine)

At the time of starting the engine 14 and during the normal operation of the engine 14, in order to set the system fuel pressure to a low pressure in accordance with the operating condition of the engine 14, the ECU 65 turns the change-over valve 40 to the OFF state. As a result, as in the first embodiment, the system fuel pressure is adjusted to a low pressure. If, in this state, surplus fuel (return fuel) is discharged from the pressure regulating chamber 44 of the pressure regulator 38, the fluid valve 62 is opened by the return fuel, whereby it is possible to discharge the fuel in the back pressure chamber 45 of the pressure regulator 38 via the downstream side path 50*b* and the atmospheric pressure path 53. In order to set the system fuel pressure to a high pressure in accordance with the operating condition of the engine 14, the ECU 54 turns the change-over valve 40 to the ON state. As a result, as in the first embodiment, the system fuel pressure can be adjusted to a high pressure. In this way, the system fuel pressure can be changed to a high pressure or a low pressure.

(Operation at Time of Stopping Engine)

Figure 10:
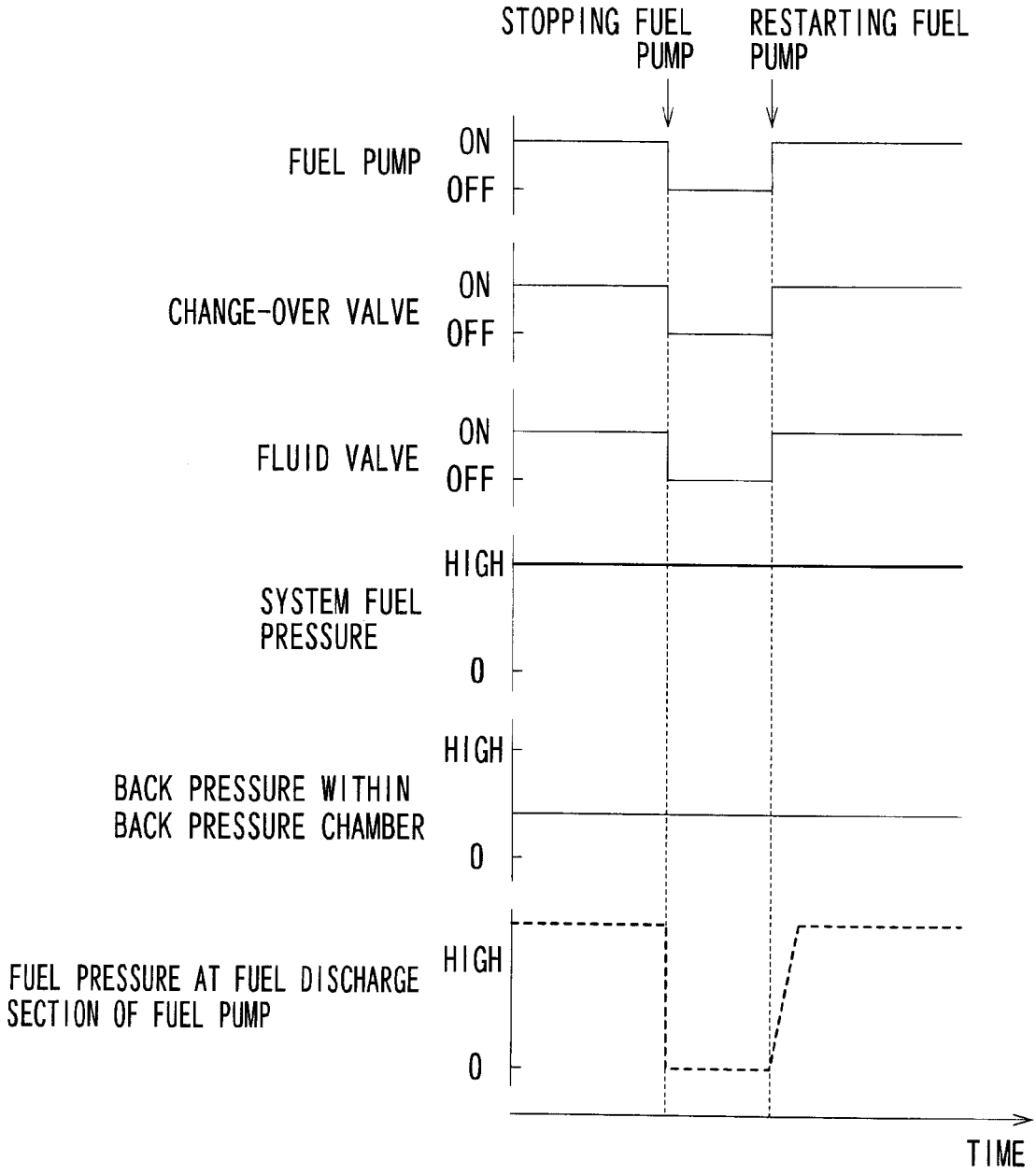
FIG. 10 is a time chart illustrating changes in fuel pressure at the time of engine stop.

The operation at the time of stopping the engine 14 will be described. FIG. 10 is a time chart illustrating changes in fuel pressure when the engine 14 is stopped and after the engine 14 has been stopped. In FIG. 10, the horizontal axis indicates time, and the vertical axis indicates the ON/OFF state of the fuel pump 18, the ON/OFF state of the change-over valve 40, the ON/OFF state of the fluid valve 62, the state of the system fuel pressure, the state of the back pressure of the back pressure chamber 45, and the fuel pressure of the fuel discharge portion (the portion of the fuel discharge port 23 on the upstream side of the check valve 34) of the fuel pump 18, in this order as from above.

When the engine 14 is stopped, the ECU 54 turns the change-over valve 40 to the OFF state, with the system fuel pressure heightened, and then turns the fuel pump 18 to the OFF state to stop the fuel pump 18. By turning the change-over valve 40 to the OFF state, the communication between the upstream side path 50*a* of the back pressure introduction path 50 and the downstream side path portion thereof is blocked. Further, since there is no surplus fuel (return fuel) discharged from the pressure regulating chamber 44 of the pressure regulator 38, the fluid valve 62 is closed. As a result, the back pressure of the back pressure chamber 45 of the pressure regulator 38 is maintained at a high level to prevent reduction in the fuel pressure of the pressure regulating chamber 44 (i.e., the system fuel pressure), and, at the same time, in the fuel supply path 30, the check valve 34 of the fuel discharge port 23 of the fuel pump 18 is closed, and the fuel injection valves 16 are closed, whereby the valves 34 and 16 are sealed from each other, so that it is possible to maintain a heightened system pressure in the fuel supply path 30 as the residual pressure (See FIG. 10). Thus, by maintaining a high residual pressure in the fuel supply path 30, it is possible to suppress generation of vapor in the fuel supply path 30 when the engine is at a high temperature.

(Operation at Time of Restarting Engine)

The operation at the time of restarting the engine 14 while the engine 14 being at a high temperature will be described. When the engine 14 is stopped, the system fuel pressure is maintained at a high level as described above (See FIG. 10). Thus, generation of vapor in the fuel supply path 30 caused when the engine is at high temperature is suppressed, whereby it is possible to achieve an improvement in terms of the restarting property of the engine 14. The other operation is the same as the operation when starting the engine 14.

With the fuel supply system 10 of this embodiment also, it is possible to obtain the same effects as those of the first embodiment described above.

Further, the fluid valve 62 for opening and closing the atmospheric pressure path 53 of the change-over valve 40 of the change-over device is closed when the engine 14 is stopped, whereby it is possible to prevent outflow of the fuel in the back pressure chamber 45 of the pressure regulator 38.

Further, by using a fluid drive type valve as the fluid valve 62, it is possible to omit the electromagnetic device needed for the electromagnetic valve 60 (See FIG. 4) of the second embodiment, and to omit the control by the ECU 54.

Figure 11:
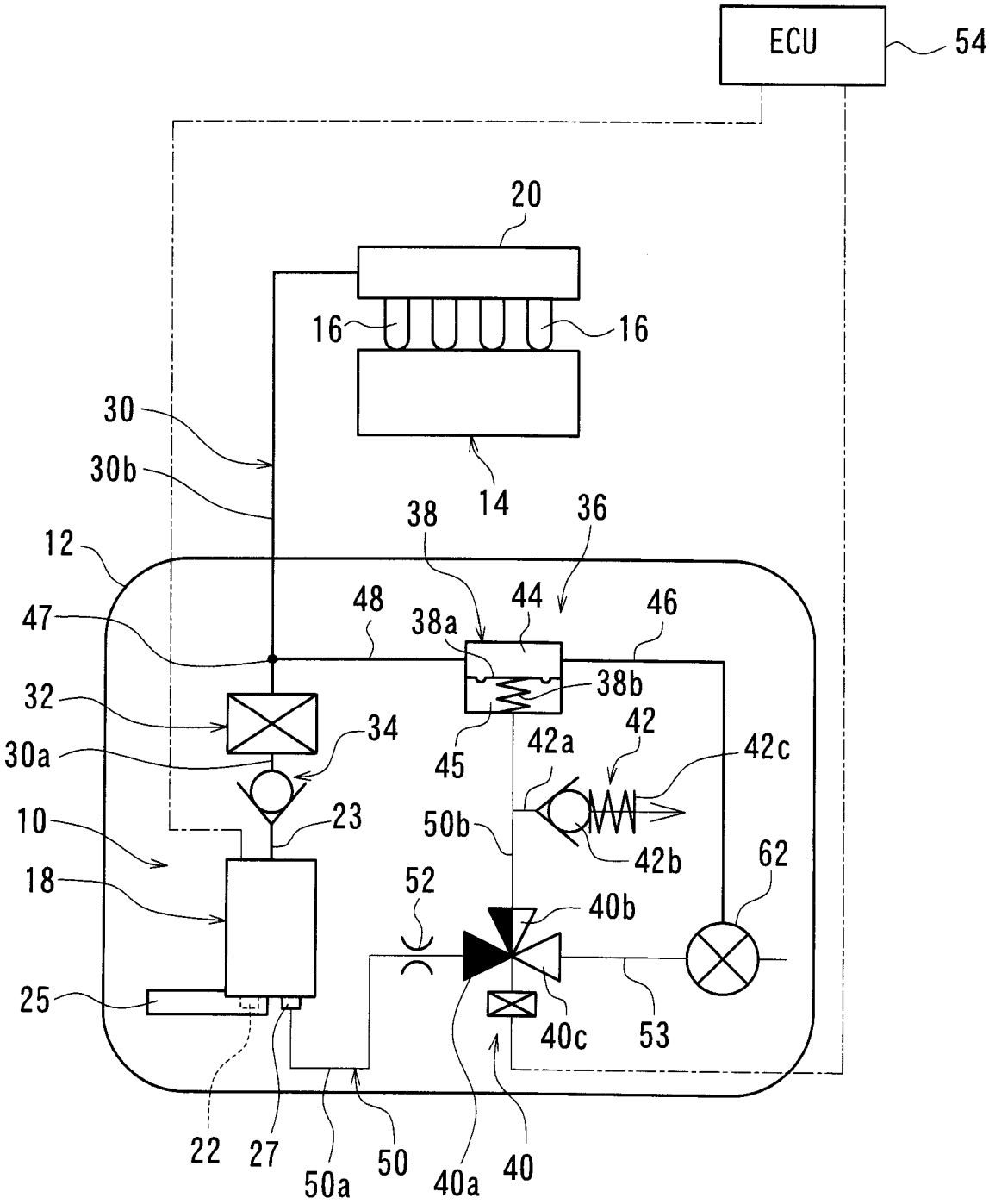
FIG. 11 is a schematic diagram showing the construction of a fuel supply system according to a modification of the third embodiment.

In an alternative embodiment, as shown in FIG. 11, the upstream side end portion of the upstream side path 50*a* of the back pressure introduction path 50 may be connected to the vapor discharge port 27 of the fuel pump 18 instead of being connected to the diverting portion 58 of the pressure regulating and introduction path 48.

Fourth Embodiment

Figure 12:
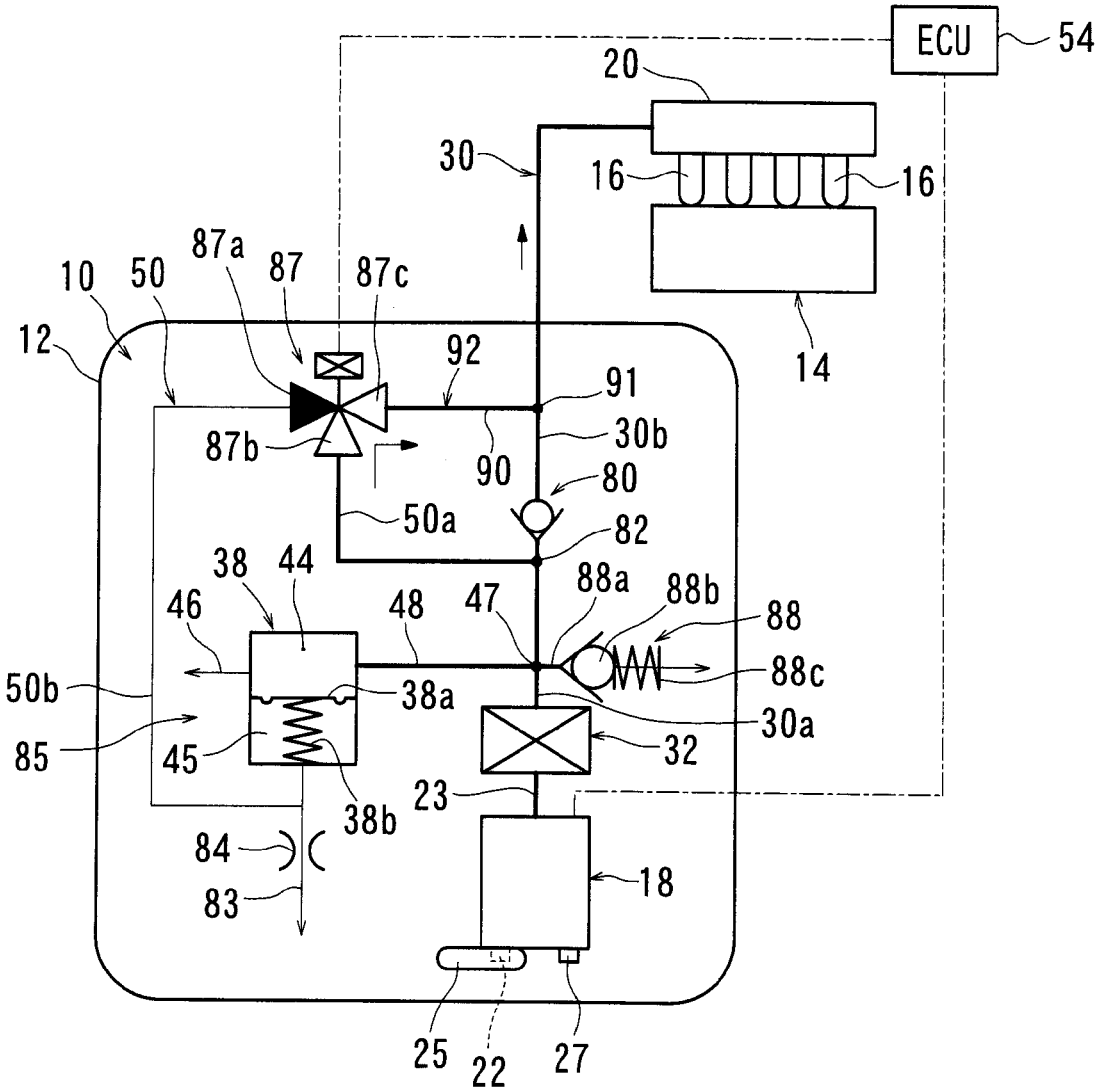
FIG. 12 is a schematic diagram showing the construction of a fuel supply system according to a fourth embodiment.
Figure 13:
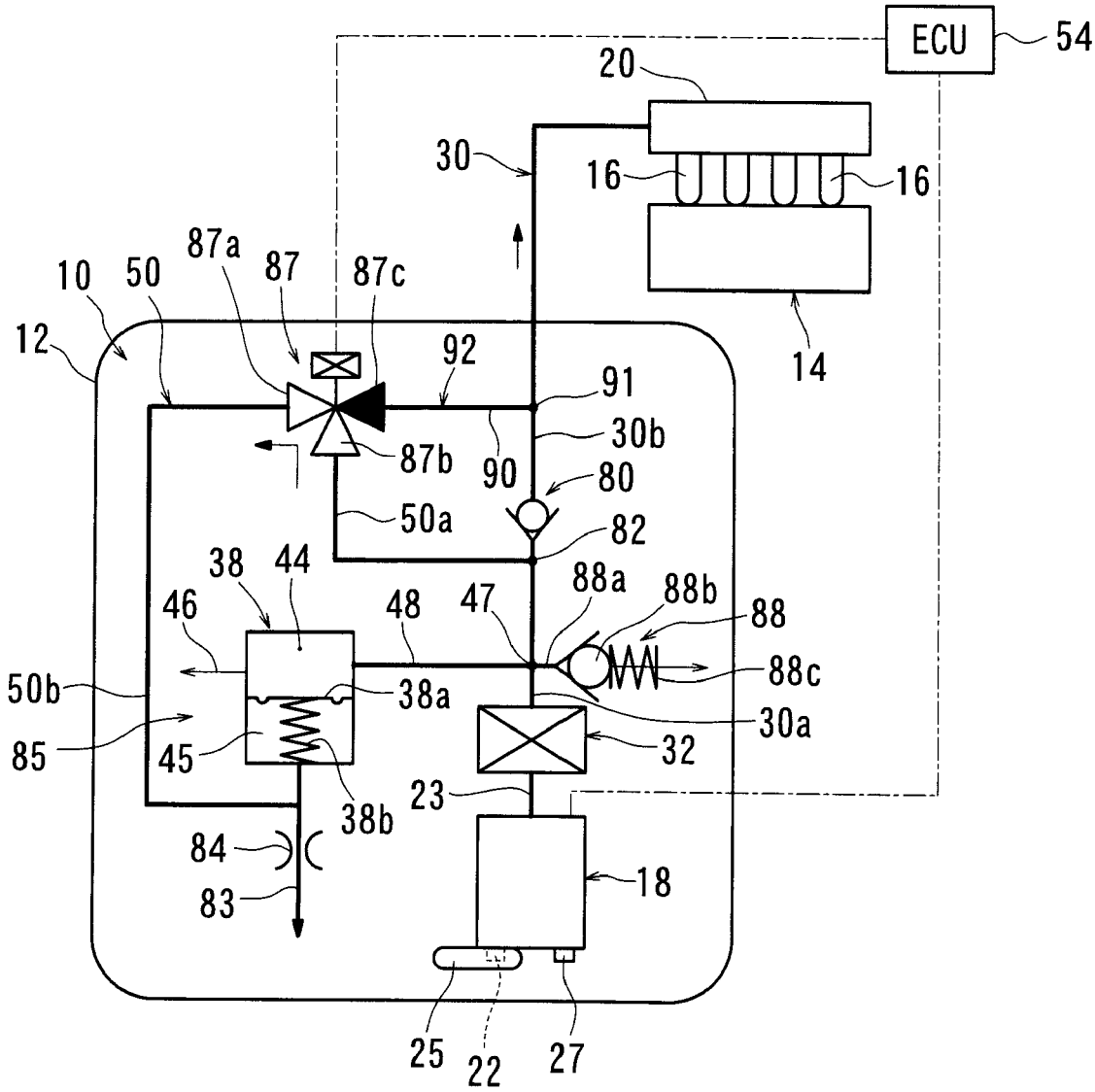
FIG. 13 is an explanatory view of the fuel supply system with the system fuel pressure heightened.
Figure 14:
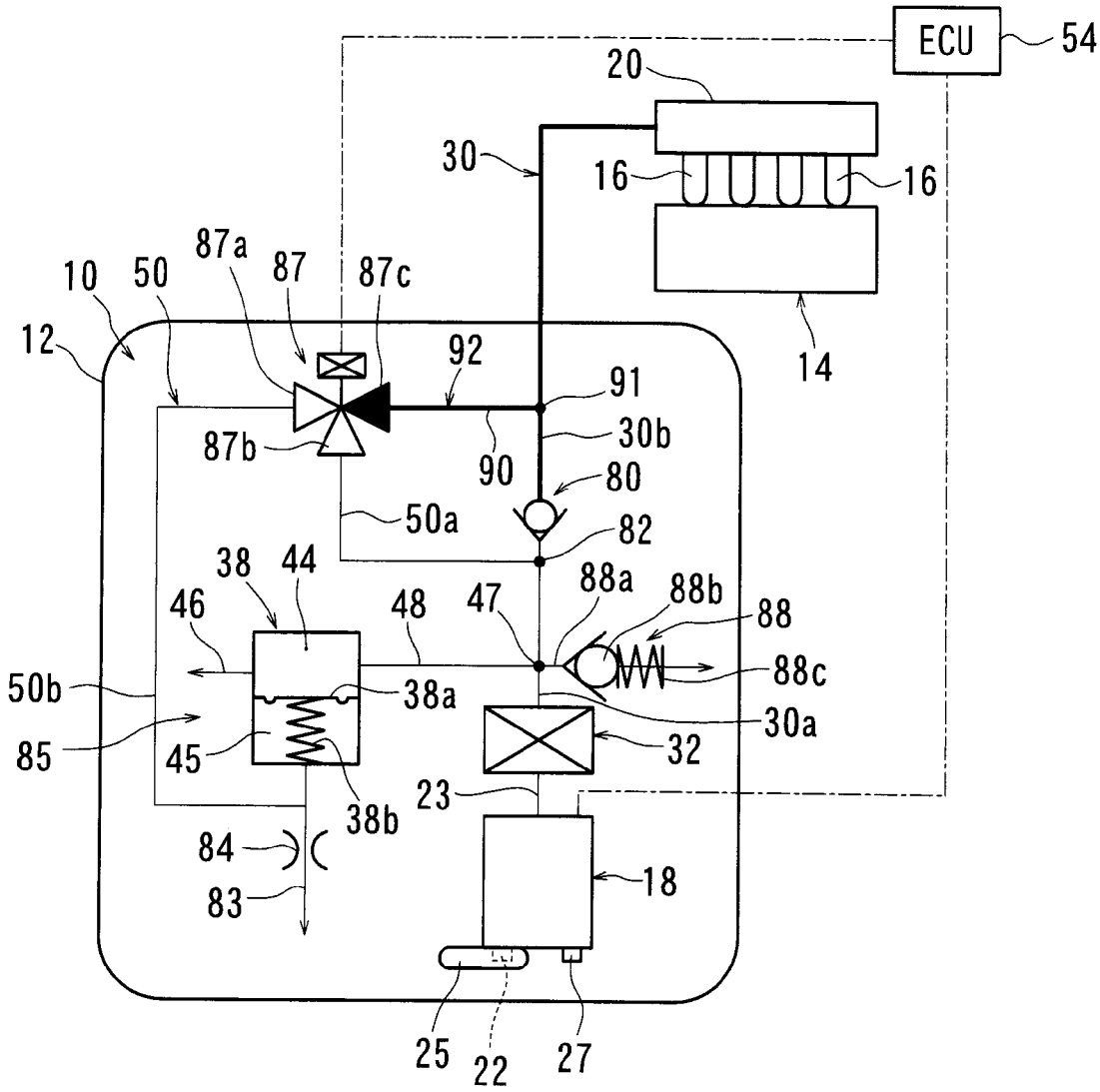
FIG. 14 is an explanatory view of the fuel supply system in the state at the time of engine stop.
Figure 15:
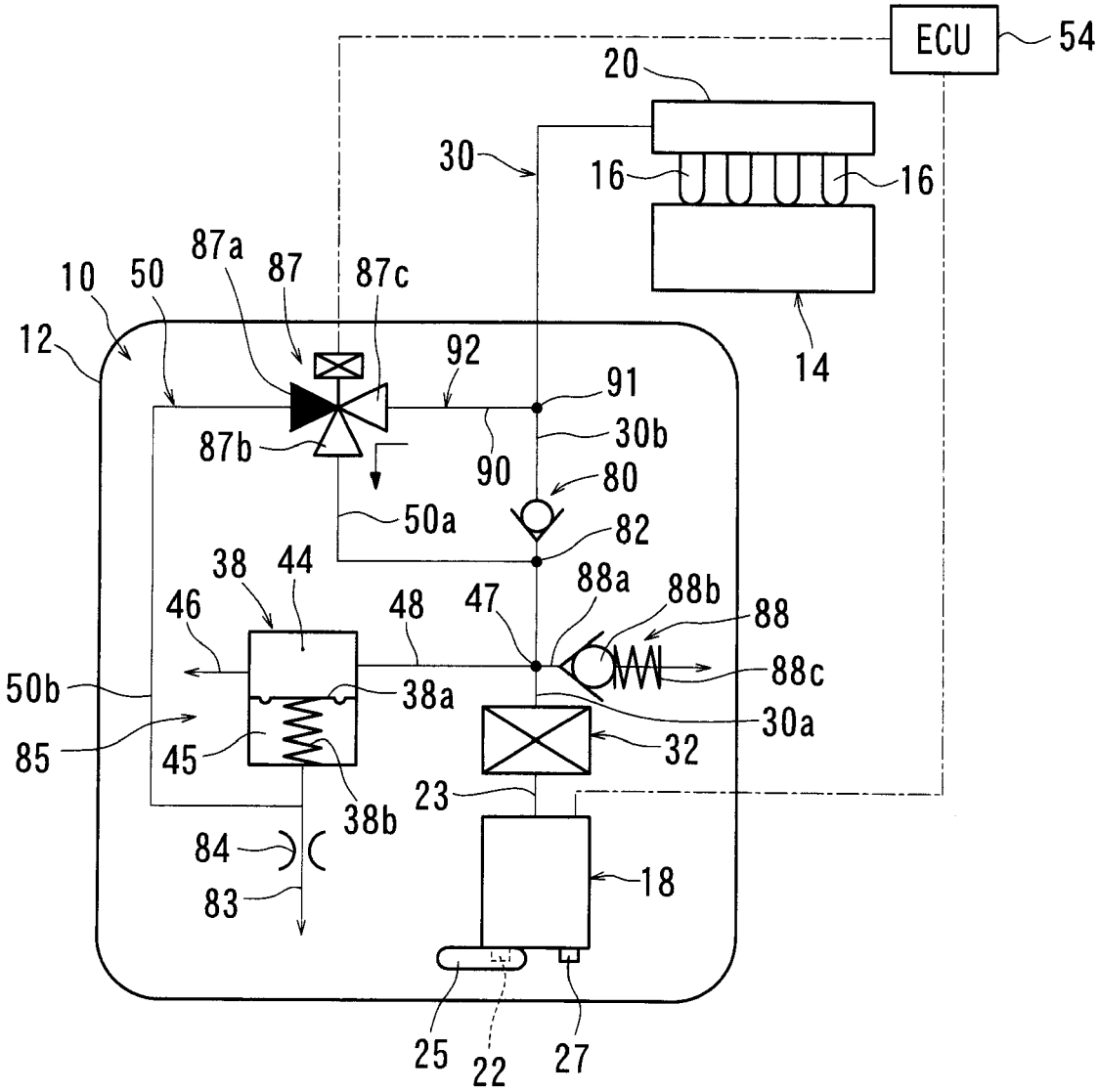
FIG. 15 is an explanatory view of the fuel supply system with the engine cooled.

A fourth embodiment of the present invention will be described. Since this embodiment is realized by partially modifying the first embodiment (See FIG. 1), the following description will be focused on the modified portion. FIG. 12 is a schematic diagram showing the construction of a fuel supply system of the fourth embodiment, FIG. 13 is an explanatory view of the same with the system fuel pressure heightened, FIG. 14 is an explanatory view of the same in the state when the engine is stopped, and FIG. 15 is an explanatory view of the same in the state after the engine is cooled.

As shown in FIG. 12, the fuel tank 12, the fuel injection valves 16, the fuel pump 18, the delivery pipe 20, the inlet filter 25, the fuel supply path 30, the fuel filter 32, the pressure regulator 38, the pressure regulating and introduction path 48, and the ECU 54, are the same as those of the first embodiment, so a description thereof will be omitted. The check valve 34 in the first embodiment (See FIG. 1) is omitted. It is also possible for the check valve 34 not to be omitted. The throttle portion 52 and the check vale 56 in the upstream side path 50*a* of the back pressure introduction path 50 of the first embodiment (See FIG. 1) are omitted.

In the downstream side path 30*b* of the fuel supply path 30, there is provided a check valve 80 for preventing backflow of the fuel. The check valve 80 may be a ball valve type check valve. The check valve 80 is arranged on the downstream side of the diverting point 47 in the fuel supply path 30. The upstream side end portion of the upstream side path 50*a* of the back pressure introduction path 50 of the first embodiment (See FIG. 1) is connected to a diverting portion 82 of the downstream side path 30*b* of the fuel supply path 30 instead of being connected to the vapor discharge port 27 of the fuel pump 18. The diverting portion 82 is arranged between the diverting point 47 and the check valve 80. As a result, the fuel diverted from the downstream side of the diverting point 47 is introduced into the back pressure chamber 45 via the back pressure introduction path 50. Further, an atmospheric pressure path 83 is branched off from the downstream portion of the downstream side path 50*b* of the back pressure introduction path 50. The downstream end of the atmospheric pressure path 83 is open to the atmospheric pressure. Further, in the atmospheric pressure path 83, there is provided a throttle portion 84 for restricting the amount of fuel discharged from the downstream side path 50*b* of the back pressure introduction path 50.

The system fuel pressure of the fuel supplied to the fuel injection valves 16 can be varied by a fuel pressure varying device 85. The fuel pressure varying device 85 is equipped with the pressure regulator 38, a change-over valve 87, and a relief valve 87. As stated above, the pressure regulator 38 is the same as that of the first embodiment, so a description thereof will be omitted.

Like the change-over valve 40 (See FIG. 1) of the first embodiment, the change-over valve 87 may be a three-way valve of electromagnetic drive type, and has three ports 87*a*, 87*b*, and 87*c*. When an electric power is not supplied to the change-over valve 87, the first port 87*a* is closed, and the second port 87*b* and the third port 87*c* communicate with each other. When an electric power is supplied to the change-over valve 87, the first port 87*a* and the second port 87*b* communicate with each other, and the third port 87*c* is closed. The supply of electric power to the change-over valve 87 is controlled by the ECU 54. Thus, the change-over valve 87 and the ECU 54 constitute a change-over device. In the state of FIGS. 12 and 15, no electric power is supplied to the change-over valve 87 (hereinafter called an OFF state), and in the state of FIGS. 13 and 14, an electric power is supplied to the change-over valve 87 (hereinafter called an ON state).

The change-over valve 87 is provided between the upstream side path 50*a* and the downstream side path 50*b* of the back pressure introduction path 50. That is, the downstream end of the upstream side path 50*a* of the back pressure introduction path 50 is connected to the second port 87*b*, and the upstream end of the downstream side path 50*b* is connected to the first port 87*a*. The third port 87*c* is connected to a connection portion 91 of the downstream side path 30*b* of the fuel supply path 30 via a communication path 90. The connection portion 91 is arranged on the downstream side of the check valve 80 in the fuel supply path 30. Further, a bypass path 92 bypassing the check valve 80 is constituted by the upstream side path 50*a* of the back pressure introduction path 50 and the communication path 90.

Like the relief valve 42 of the first embodiment (See FIG. 1), the relief valve 88 is equipped with a relief flow path 88*a*, a valve member 88*b* constituted by a ball valve capable of opening/closing the relief flow path 88*a*, and a return spring 88*cc* pressing the valve member 88*b* in a closing direction. The relief flow path 88*a* is connected to the diverting point 47. In the state in which the system fuel pressure is high, when the fuel pressure in the pressure regulating chamber 44 of the pressure regulator 38 becomes higher than the resilient force of the return spring 88*c*, the valve member 88*b* is moved against the resilient force of the return spring 88*c* to open the relief valve 88, allowing the fuel in the pressure regulating chamber 44 to be relieved via the relief flow path 88*a*. When the fuel pressure in the pressure regulating chamber 44 is reduced to a set value, the valve member 88*b* is closed by the resilient force of the return spring 88*c*. Thus, when the system fuel pressure is high, the fuel pressure in the pressure regulating chamber 44 is maintained at the set pressure by the relief valve 88, Next, the operations of the fuel supply system 10 of the fourth embodiment will be described.

(Operations at Time of Starting Engine and During Normal Operation of Engine)

If, at the time of starting the engine 14, the fuel pump 18 is driven, with the change-over valve 87 in the OFF state, the system fuel pressure of the fuel supplied to the fuel injection valves 16 via the fuel supply path 30 is increased. At this time, in the state in which the change-over valve 87 is the OFF state (See FIG. 12), the back pressure introduction path 50 is blocked, so that the fuel discharged from the fuel pump 18 is not introduced into the back pressure chamber 45 of the pressure regulator 38. Further, since the back pressure chamber 45 is open to the atmosphere via the atmospheric pressure path 83 (inclusive of a part of the downstream side path 50*b* of the back pressure introduction path 50), the pressure in the back pressure chamber 45 corresponds to the atmospheric pressure. Further, the fuel discharged from the fuel pump 18 is introduced into the pressure regulating chamber 44 of the pressure regulator 38 via the pressure regulating and introduction path 48 diverting from the diverting point 47. Thus, the diaphragm 38*a* of the pressure regulator 38 is deformed or displaced due to a difference between the force (back pressure) F1 receiving from within the back pressure chamber 45 and the force (system fuel pressure) F2 receiving from within the pressure regulating chamber 44. Here, since the pressure in the back pressure chamber 45 corresponds to the atmospheric pressure, the back pressure F1 of the back pressure chamber 45 is produced only by the spring load of the spring 38*b*. And, if F1≧F2, the fuel in the pressure regulating chamber 44 is not discharged via the return fuel path 46. If F1<F2, the fuel of the pressure regulating chamber 44 is discharged as surplus fuel, i.e., so-called return fuel, via the return fuel path 46, whereby the system fuel pressure is reduced to the set value. As a result, the system fuel pressure is adjusted to a low pressure. Further, communication is established between the upstream side path 50*a* of the back pressure introduction path 50 and the communication path 90, that is, via the bypass path 92.

If, in the state in which the fuel pump 18 is being driven, the change-over valve 87 is turned to the ON state, communication is established between the upstream side path 50*a* and the downstream side path 50*b* of the back pressure introduction path 50, so that the fuel discharged from the fuel pump 18 is introduced into the back pressure chamber 45 of the pressure regulator 38 via the back pressure introduction path 50 (See FIG. 13). Further, the passage between the downstream side path 50*b* of the back pressure introduction path 50 and the communication path 90, that is, the bypass path 92 is blocked. Since the throttle portion 84 is provided in the atmospheric pressure path 83, the amount of fuel discharged from the downstream side path 50*b* of the back pressure introduction path 50 is restricted to a predetermined amount. Thus, the fuel pressure due to the fuel discharged from the fuel pump 18 acts on the interior of the back pressure chamber 45, so that the pressure in the back pressure chamber 45 is higher than the atmospheric pressure. That is, the back pressure (F1) of the back pressure chamber 45 is the sum of the spring load of the spring 38*b* and the fuel pressure exerted in the back pressure chamber 45. With this, the fuel pressure of the pressure regulating chamber 44, that is, the system fuel pressure is adjusted to a high pressure. At this time, the fuel pressure in the pressure regulating chamber 44 is controlled by the relief valve 88 to be the set pressure applied when the fuel pressure is high.

Next, when the change-over valve 87 is turned to the OFF state, the back pressure introduction path 50 is blocked as described above, so that the pressure in the back pressure chamber 45 is reduced to a level corresponding to the atmospheric pressure (See FIG. 12). As a result, the system fuel pressure is adjusted to a low pressure. In this way, the ECU 54 performs a change-over control of the change-over valve 87 in accordance with the operating condition of the engine 14, whereby it is possible to change the system fuel pressure to a high pressure or a low pressure. This means that the system fuel pressure is variable.

Simultaneously with the turning the change-over valve 87 to the OFF state, communication is established between the upstream side path 50*a* of the back pressure introduction path 50 and the communication path 90, that is, via the bypass 92. Thus, it is possible to achieve an improvement in terms of responsiveness in lowering of the system fuel pressure. For example, if there were no communication path 90, the system fuel pressure between the check valve 80 and the fuel injection valves 16 would only be reduced by an amount corresponding to the consumption on the engine side, so that the system fuel pressure would have a value naturally changes after turning the change-over valve 87 to the OFF state until reduction in the system fuel pressure between the check valve 80 and the fuel injection valves 16 to a low pressure, resulting in a rather poor responsiveness for reduction in pressure. In contrast, by allowing communication via the bypass path 92 simultaneously with turning the change-over valve 87 to the OFF state, it is possible to achieve an improvement in terms of responsiveness in lowering of the system fuel pressure.

(Operation at Time of Stopping Engine)

As in the first embodiment, at the time of stopping the engine 14, the ECU 54 turns the fuel pump 18 to the OFF state, with the system fuel pressure heightened (See FIG. 13), to thereby stop the fuel pump 18 (See FIG. 14). As a result, the bypass path 92 bypassing the check valve 80 provided in the path on the downstream side of the diverting portion 82 leading to the back pressure chamber 45 of the pressure regulator 38 of the fuel supply path 30, is blocked by the change-over valve 87 of the change-over device, and, at the same time, the check valve 80 in the fuel supply path 30 and the fuel injection valves 16 are closed, whereby the check valve 80 and the change-over valve 87 are sealed from each other. Therefore, it possible to maintain a heightened system fuel pressure in the fuel supply path 30 as the residual pressure. Thus, a high residual pressure is maintained as the residual pressure in the portion of the fuel supply path 30 on the downstream side of the check valve 80, whereby it is possible to suppress generation of vapor in the fuel supply path 30 to thereby achieve an improvement in terms of restarting property.

After the engine 14 and the fuel pump 18 have been stopped, the ECU 54 maintains the ON state of the change-over valve 87 as long as the engine 14 is at a high temperature. The period of time that the ECU 54 maintains the ON state of the change-over valve 87 (e.g., 20 to 30 minutes) is, for example, a period of time required for the engine 14 to attain a low temperature state after the stopping of the engine 14 and the fuel pump 18 and for generation of no or substantially no vapor in the fuel supply path 30. The ECU 54 measures the period of time, during which the change-over valve is kept in the ON state, by means of a timer, and turns the change-over valve 87 to the OFF state after that period of time has elapsed (See FIG. 15). As a result, communication via the bypass path 92 is established, so that it is possible to release the maintaining of the residual pressure, that is, to reduce the residual pressure.

(Operation at Time of Restarting Engine)

The operation at the time of restarting the engine 14 while the engine being at a high temperature will be described. As stated above, while the engine 14 is stopped, the system fuel pressure is maintained at a high level (See FIG. 14). Thus, generation of vapor in the fuel supply path 30 when the engine is at a high temperature is suppressed, whereby it is possible to achieve an improvement in terms of the restarting property of the engine 14 (See FIG. 13). The other operation is the same as that at the time of starting the engine 14 (See FIG. 12).

With the fuel supply system 10 of this embodiment also, it is possible to obtain the same effects as those of the first embodiment.

Further, it is only necessary for the sealing portions related to the maintaining of the residual pressure of the system fuel pressure to be the two portions of the check valve 80 and the change-over valve 87, so that it is possible to achieve an improvement in terms of sealing property and to realize simplification in construction.

Fifth Embodiment

Figure 16:
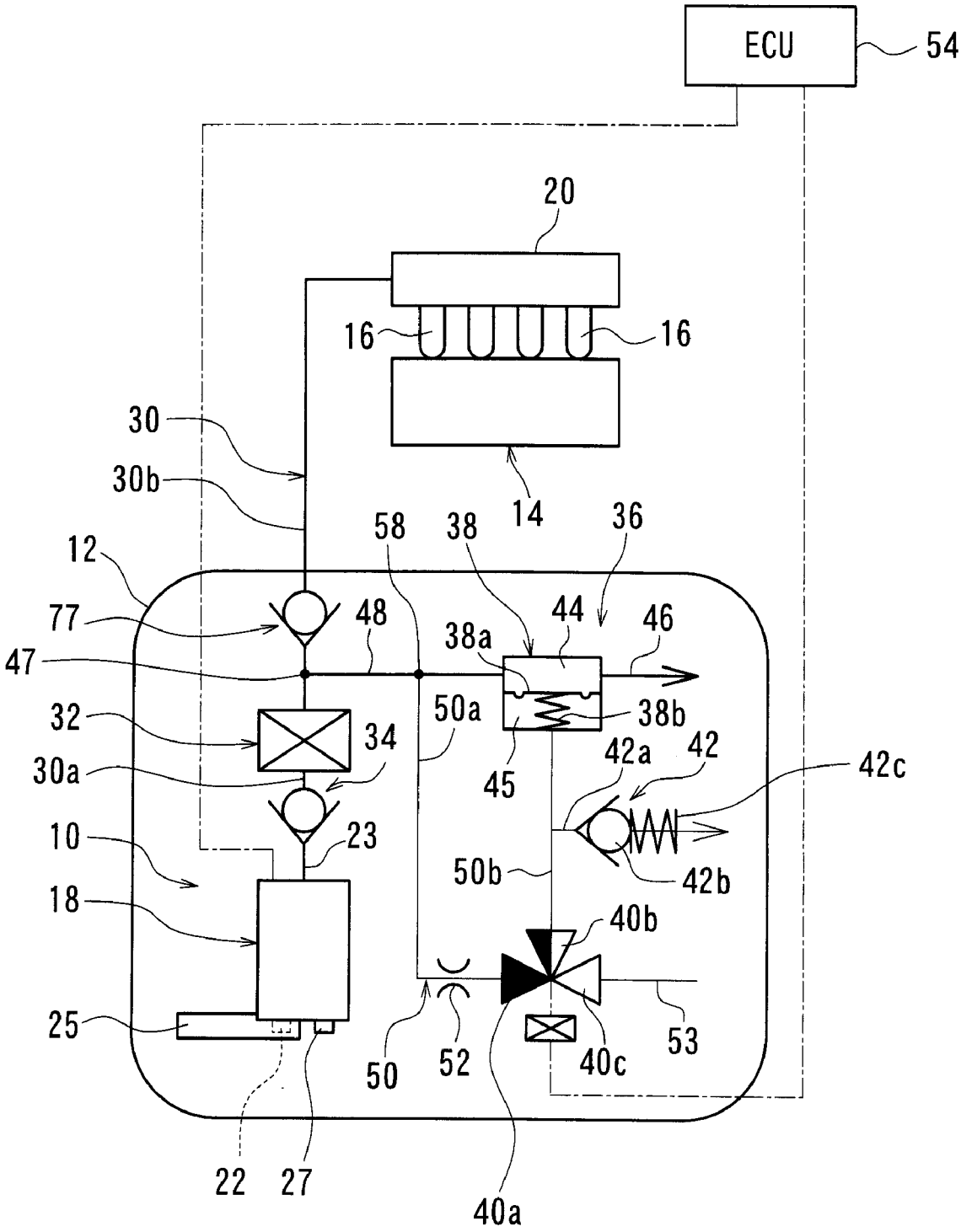
FIG. 16 is a schematic diagram showing the construction of a fuel supply system according to a fifth embodiment.

A fifth embodiment of the present invention will be described. Since this embodiment is realized through partial modification of the second embodiment, the following description will be focused on the modified portion. FIG. 16 is a schematic diagram showing the construction of a fuel supply system of the fifth embodiment.

As shown in FIG. 16, in this embodiment, the electromagnetic valve 60 of the second embodiment (See FIG. 4) is omitted. And, in the downstream side path 30*b* of the fuel supply path 30, there is provided a check valve 77 situated near the diverting point 47. The check valve 77 may be a ball valve type check valve. Next, the operations of the fuel supply system 10 of the fifth embodiment will be described.

(Operations at Time of Starting Engine and During Normal Operation of Engine)

At the time of starting the engine 14 and during the normal operation of the engine 14, in order to set the system fuel pressure to a low pressure in accordance with the operating condition of the engine 14, the ECU 54 turns change-over valve 40 to the OFF state. As a result, as in the first embodiment, the system fuel pressure is adjusted to a low pressure. The system fuel pressure in this embodiment is the fuel pressure between the check valve 77 in the fuel supply path 30 and the fuel injection valves 16. The fuel pressure between the check valves 34 and 77, arranged with the diverting point 47 in the fuel supply path 30 therebetween, will be referred to as "intermediate portion fuel pressure."

In order to set the system fuel pressure to a high pressure in accordance with the operating condition of the engine 14, the ECU 54 turns the change-over valve 40 to the ON state. As a result, as in the first embodiment, the system fuel pressure is adjusted to a high pressure. In this way, the system fuel pressure can be changed to a high pressure or a low pressure. In this case, the system fuel pressure and the intermediate portion fuel pressure are of the same value.

(Operation at Time of Stopping Engine)

Figure 17:
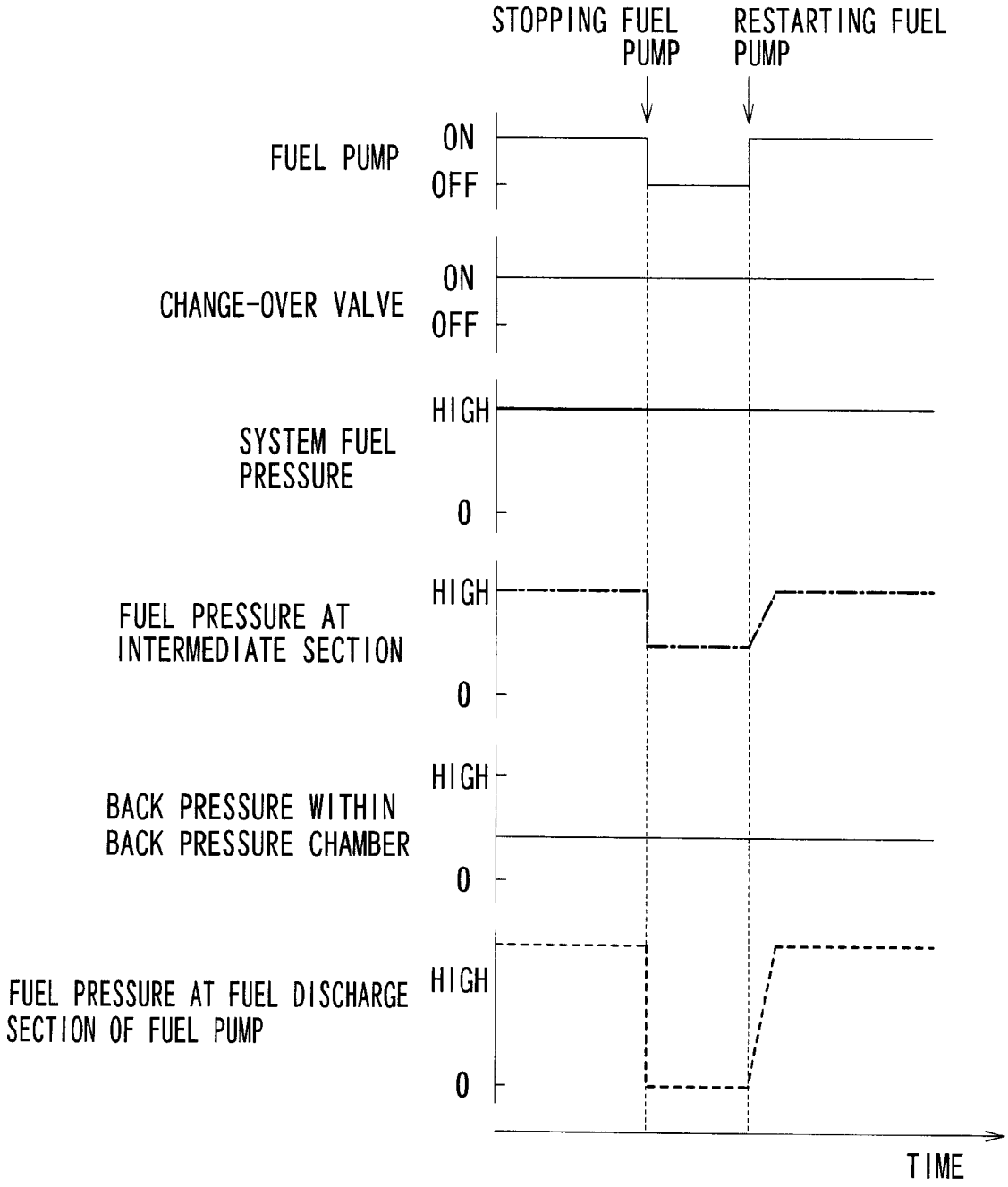
FIG. 17 is a time chart illustrating changes in fuel pressure at the time of engine stop.

The operation at the time of stopping the engine 14 will be described. FIG. 17 is a time chart illustrating changes in fuel pressure when the engine 14 is stopped and after the engine 14 has been stopped. In FIG. 17, the horizontal axis indicates time, and the vertical axis indicates the ON/OFF state of the fuel pump 18, the ON/OFF state of the change-over valve 40, the state of the system fuel pressure, the state of the intermediate portion fuel pressure, the state of the back pressure of the back pressure chamber 45, and the fuel pressure of the fuel discharge portion (the portion of the fuel discharge port 23 on the upstream side of the check valve 34) of the fuel pump 18, in this order as from above.

At the time of stopping the engine 14, as in the first embodiment, the ECU 54 turns the change-over valve 40 to the OFF state, with the system fuel pressure heightened, and then turns the fuel pump 18 to the OFF state to stop the fuel pump 18. As a result, the check valve 34 at the fuel discharge port 23 of the fuel pump 18 of the upstream side path 30*a* of the fuel supply path 30 is closed, and, at the same time, the check valve 77 of the downstream side path 30*b* of the fuel supply path 30 and the fuel injection valves 16 are closed, whereby the valves 77 and 16 are sealed from each other, thereby making it possible to maintain a heightened system fuel pressure in the downstream side path 30*b* of the fuel supply path 30 as the residual pressure (See FIG. 17). Thus, by maintaining a high residual pressure in the fuel supply path 30, it is possible to suppress generation of vapor in the fuel supply path 30 when the engine is at a high temperature. Further, as the change-over valve 40 is turned to the OFF state, the back pressure chamber 45 is opened to the atmosphere via the downstream path 50*b* of the back pressure introduction path 50 and the atmospheric pressure path 53, whereby the intermediate portion fuel pressure is reduced to a low system pressure value (See FIG. 17).

(Operation at Time of Restarting Engine)

The operation at the time of restarting the engine 14 while the engine 14 being at a high temperature will be described. While the engine is stopped, the system fuel pressure is maintained at a high level as described above (See FIG. 17). Thus, generation of vapor in the fuel supply path 30 when the engine 14 is at a high temperature is suppressed, whereby it is possible to achieve an improvement in terms of the restarting property of the engine 14. The other operation is the same as that when the engine 14 is started.

With fuel supply system 10 described above, by heightening the system fuel pressure when the engine 14 is stopped, the check valve 77 provided in the downstream side path 30*b* of the fuel supply path 30 and the fuel injection valves 16 are closed, whereby the valves 77 and 16 are sealed from each other, thereby making it possible to maintain a heightened system pressure in the downstream side path 30*b* of the fuel supply path 30 as the residual pressure. Thus, by maintaining a high residual pressure in the fuel supply path 30, generation of vapor in the fuel supply path 30 when the engine is at a high temperature is suppressed, making it possible to achieve an improvement in terms of restarting property.

Further, in this embodiment, by closing the check valve 77 of the downstream side path 30*b* of the fuel supply path 30 and the fuel injection valves 16, the valves 77 and 16 are sealed from each other, so that there is no need to maintain the back pressure of the back pressure chamber 45 of the pressure regulator 38 and the fuel pressure of the pressure regulating chamber 44 (the intermediate portion fuel pressure) at a high level, thereby making it possible to achieve simplification in construction. In the case of this embodiment, the check valve 34 of the fuel discharge port 23 of the fuel pump 18 may be omitted.

Figure 18:
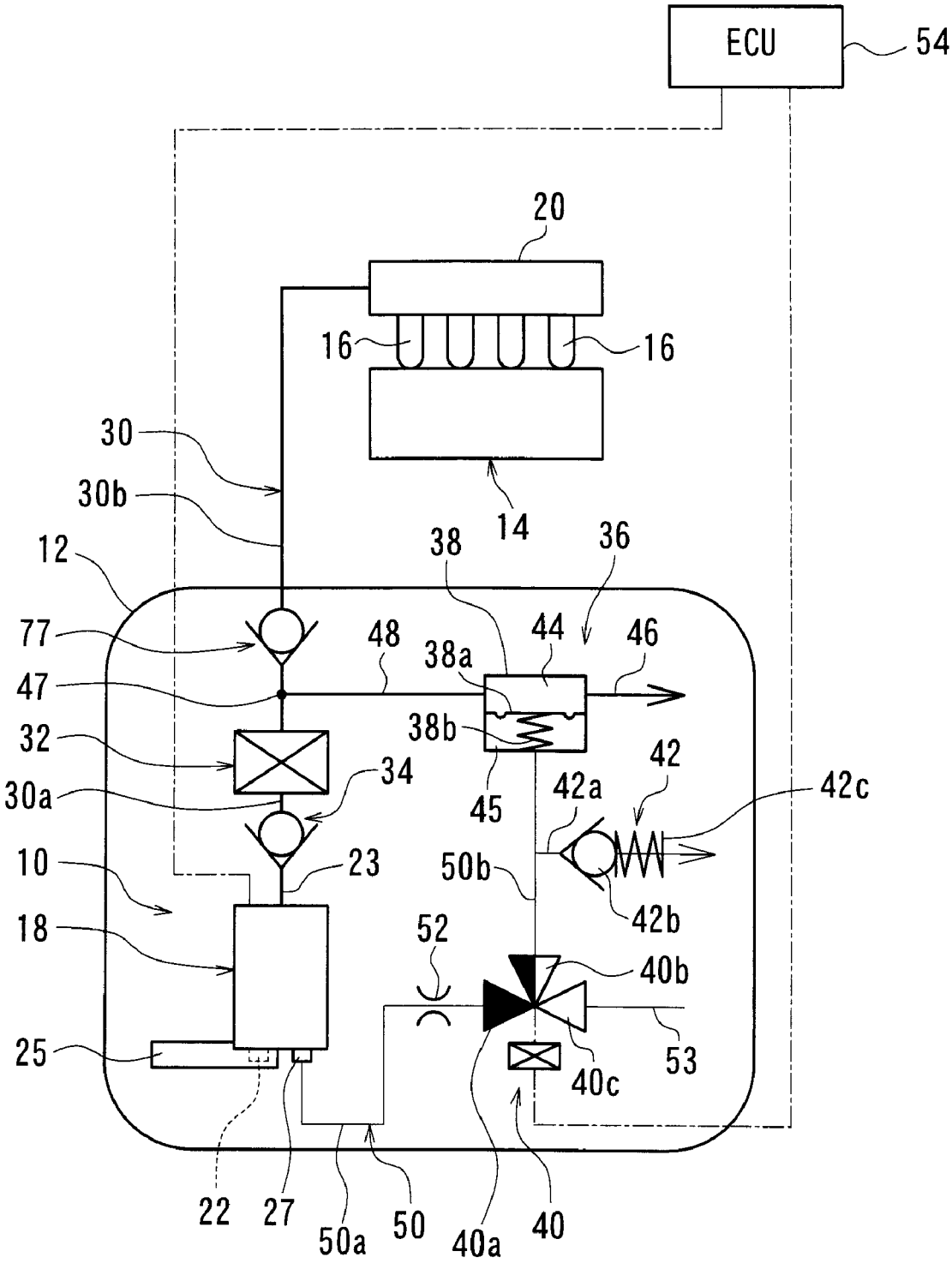
FIG. 18 is a schematic diagram showing the construction of a fuel supply system according to a modification of the fifth embodiment.
Figure 19:
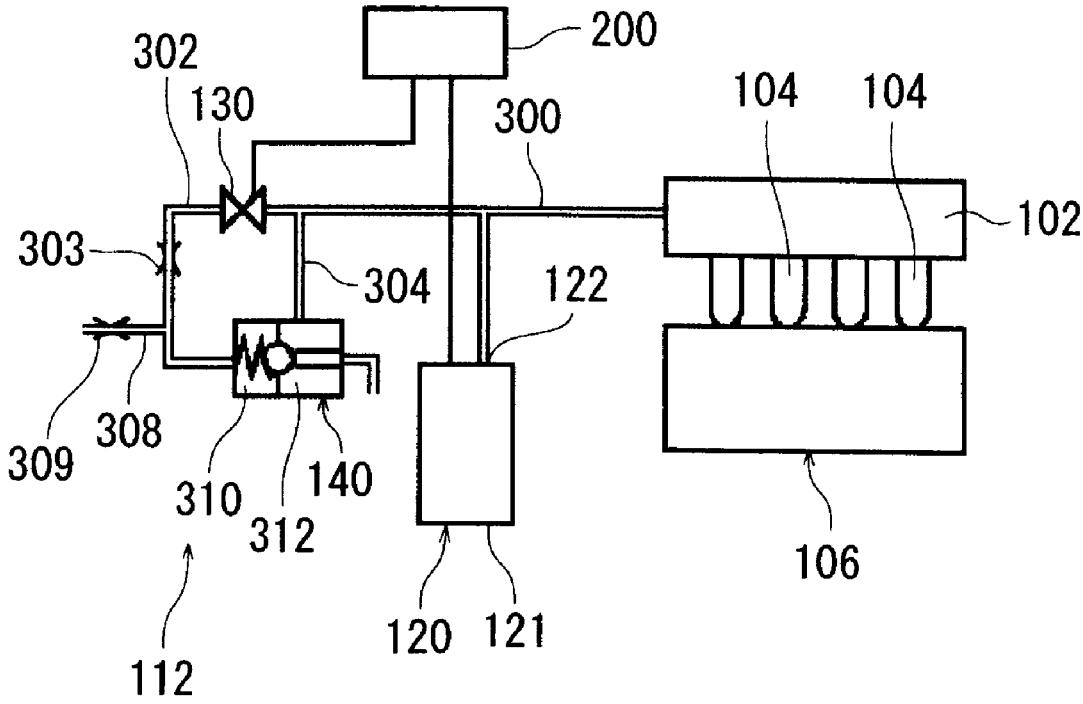
FIG. 19 PRIOR ART
FIG. 19 is a schematic diagram showing the construction of a known fuel supply system.

Further, in an alternative embodiment, as shown in FIG. 18, the upstream side end portion of the upstream side path 50*a* of the back pressure introduction path 50 of this embodiment may be connected to the vapor discharge port 27 of the fuel pump 18 instead of being connected to the diverting portion 58 of the pressure regulating introduction path 48.

The present invention may not be limited to the above first to fifth embodiments and their alternative embodiments but may be modified in various ways.

This invention claims:

1. A fuel supply system comprising:

a fuel pump capable of supplying fuel stored within a fuel tank to a fuel injecting valve device of an engine;

a pressure regulator including a pressure regulating chamber, into which a part of the fuel supplied from the fuel pump to the fuel injecting valve device can be introduced, and a back pressure chamber, into which a part of the fuel pressurized by the fuel pump can be introduced, wherein a pressure of the fuel within the pressure regulating chamber can be regulated according to a back pressure produced within the back pressure chamber, and surplus fuel not to be used within the pressure regulating chamber can be discharged from the pressure regulator;

a change-over device configured to be able to change between a fuel introduction state for introducing the fuel into the back pressure chamber of the pressure regulator and an atmospheric pressure introduction state for introducing an atmospheric pressure into the back pressure chamber of the pressure regulator, so that a system fuel pressure of the fuel supplied to the fuel injecting valve device can be changed by the change-over device;

a check valve arranged in a fuel supply path leading from the fuel pump to the fuel injecting valve device, the check valve being positioned on an upstream side of a first diverting point in the fuel supply path, from which the fuel is introduced into the pressure regulating chamber of the pressure regulator; and an outflow prevention device capable of preventing outflow of the fuel within the back pressure chamber of the pressure regulator when the engine is stopped while the system fuel pressure being heightened.

2. The fuel supply system as in claim 1, further comprising:

an upstream side path diverged from the fuel supply path at a second diverting point positioned on an upstream side of the check valve, so that a part of the fuel is introduced into the back pressure chamber of the pressure regulator via the upstream side path;

wherein the outflow prevention device comprises a check valve arranged in the upstream side path at a position on an upstream side of the change-over device and capable of preventing backflow of the fuel.

3. The fuel supply system as in claim 1, wherein the outflow preventing device comprises a valve device capable of opening and closing a path leading from the back pressure chamber of the pressure regulator to the change-over device.

4. The fuel supply system as in claim 1, wherein the outflow preventing device comprises a valve device capable of opening and closing an atmospheric side path of the change-over device.

5. A fuel supply system comprising:

a fuel pump capable of supplying fuel stored within a fuel tank to a fuel injecting valve device of an engine;

a pressure regulator including a pressure regulating chamber, into which a part of the fuel diverted from a first diverting point in a fuel supply path leading from the fuel pump to the fuel injecting valve device can be introduced, and a back pressure chamber, into which a part of the fuel diverted from a second diverting point in the fuel supply path on a downstream side of the first diverting point can be introduced, wherein a pressure of the fuel within the pressure regulating chamber can be regulated according to a back pressure produced within the back pressure chamber, and surplus fuel not to be used within the pressure regulating chamber can be discharged from the pressure regulator;

a change-over device configured to be able to change between a fuel introduction state for introducing the fuel into the back pressure chamber of the pressure regulator and an atmospheric pressure introduction state for introducing an atmospheric pressure into the back pressure chamber of the pressure regulator, so that a system fuel pressure of the fuel supplied to the fuel injecting valve device can be changed by the change-over device;

a check valve arranged in the fuel supply path at a position on a downstream side of the second diverting point for the back pressure chamber and capable of preventing backflow of the fuel;

a bypass path connected to the fuel supply path to bypass the check valve;

wherein the change-over device includes a change-over valve;

wherein the change-over valve is capable of allowing flow of the fuel through the bypass path when an atmospheric pressure is introduced into the back pressure chamber;

wherein the change-over valve is capable of preventing flow of the fuel through the bypass path when the fuel is introduced into the back pressure chamber; and wherein the change-over valve is capable of preventing flow of the fuel through the bypass path when the engine is stopped while the system fuel pressure being heightened.

6. A fuel supply system comprising:

a fuel pump capable of supplying fuel stored within a fuel tank to a fuel injecting valve device of an engine;

a pressure regulator including a pressure regulating chamber, into which a part of the fuel supplied from the fuel pump to the fuel injecting valve device can be introduced, and a back pressure chamber, into which a part of the fuel pressurized by the fuel pump can be introduced, wherein a pressure of the fuel within the pressure regulating chamber can be regulated according to a back pressure produced within the back pressure chamber, and surplus fuel not to be used within the pressure regulating chamber can be discharged from the pressure regulator;

a change-over device configured to be able to change between a fuel introduction state for introducing the fuel into the back pressure chamber and an atmospheric pressure introduction state for introducing an atmospheric pressure into the back pressure chamber of the pressure regulator, so that a system fuel pressure of the fuel supplied to the fuel injecting valve device can be changed by the change-over device;

a check valve arranged in a fuel supply path leading from the fuel pump to the fuel injecting valve device to prevent backflow of the fuel, the check valve being positioned on a downstream side of a diverting point in the fuel supply path, from which the fuel is introduced into the pressure regulating chamber of the pressure regulator, so that the system fuel pressure can be heightened when the engine is stopped.

* * * * *